US006263923B1

(12) United States Patent
Castillo

(10) Patent No.: US 6,263,923 B1
(45) Date of Patent: Jul. 24, 2001

(54) DEVICE FOR MAINTAINING SEPARATE INGREDIENTS IN LIQUID FOOD PRODUCTS

(76) Inventor: James A. Castillo, 1848 Kahakai Dr., #1506, Honolulu, HI (US) 96814

( * ) Notice: Subject to any disclaimer, the term of this patent is extended or adjusted under 35 U.S.C. 154(b) by 0 days.

(21) Appl. No.: 09/493,361

(22) Filed: Jan. 28, 2000

Related U.S. Application Data

(63) Continuation-in-part of application No. 09/321,676, filed on May 28, 1999.

(51) Int. Cl.[7] ..... B65B 1/04; B65B 3/04; B67C 3/02

(52) U.S. Cl. ..... 141/100; 141/104; 141/110; 141/112; 220/501; 220/502; 215/227; 215/DIG. 8; 206/219; 206/222

(58) Field of Search ..... 141/100, 102, 141/104, 110, 112; 222/83, 129, 142.5, 94–100; 220/23.88, 503; 215/6, 227, DIG. 8; 206/219–222

(56) References Cited

U.S. PATENT DOCUMENTS

| | | | |
|---|---|---|---|
| 3,179,275 | 4/1965 | Roskam . | |
| 3,225,915 | 12/1965 | Wise . | |
| 3,779,372 | 12/1973 | de Lloret . | |
| 4,024,952 | 5/1977 | Leitz . | |
| 4,221,291 | 9/1980 | Hunt . | |
| 4,264,007 | 4/1981 | Hunt . | |
| 4,618,444 | 10/1986 | Hudson . | |
| 5,064,073 | 11/1991 | Folland . | |
| 5,114,011 | 5/1992 | Robbins, III . | |
| 5,431,276 | 7/1995 | Lialin . | |
| 5,529,179 | 6/1996 | Hanson . | |
| 5,885,635 | 3/1999 | Spring et al. . | |
| 6,003,728 * | 12/1999 | Elliott | 222/81 |
| 6,047,818 * | 4/2000 | Warby et al. | 206/221 |
| 6,059,443 * | 5/2000 | Casey | 366/130 |
| 6,152,296 * | 11/2000 | Shih | 206/222 |

* cited by examiner

*Primary Examiner*—Timothy L. Maust
(74) *Attorney, Agent, or Firm*—Leighton K. Chong

(57) ABSTRACT

A device for maintaining ingredients separately within a container, of the type having a removable container cap applied on a neck with a central opening, has a sub-container body mounted in the container neck which is formed with a proximate end having screw threads which can be engaged with internal screw threads in the container neck for holding them securely together to allow the ingredients to be shaken out of the sub-container body and mixed with fluid in the container. The sub-container body can have inner divider walls forming multiple compartments with respective orifices for dispensing ingredients selectively from the compartments. The sub-container body may be sealed to the underside of the cap with a sealing film, or seated on the neck rim and held by the cap. In one version, the proximate end of the sub-container body has a protruding shape with inclined walls for guiding it into the neck opening. In other versions, the sub-container body is formed integrally with the container cap, or is formed as an annular ring shape carried between inner and outer flanges of the cap. These improved devices allow viscous or powdered ingredients to be mixed by shaking with fluid in the container without risk of spilling or splashing outside the container.

4 Claims, 22 Drawing Sheets

FIG. 7A
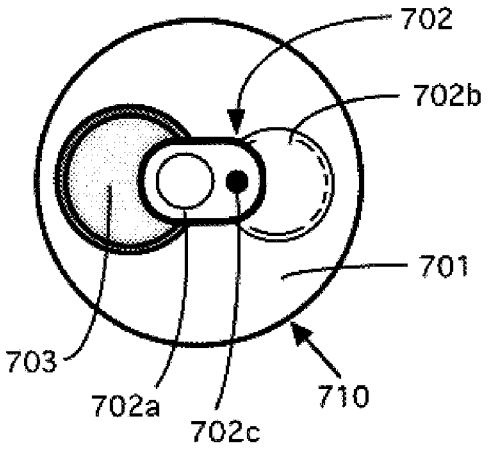
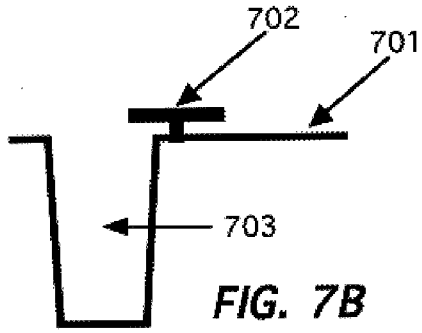
FIG. 7B
FIG. 7C
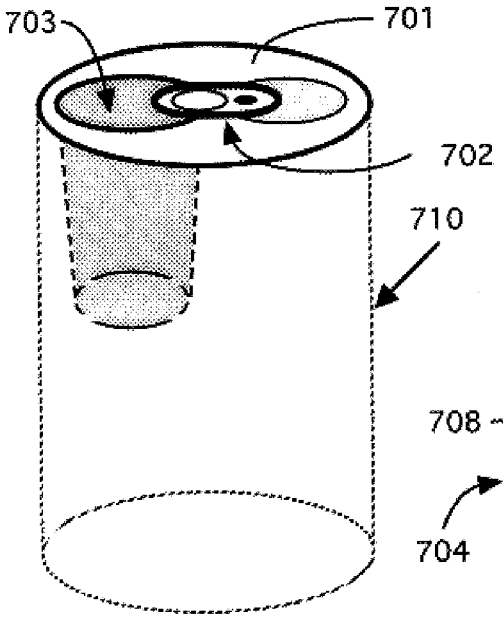
FIG. 7D
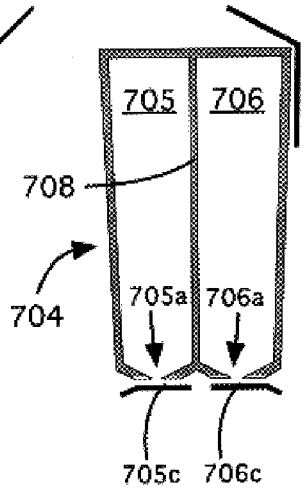
FIG. 7E
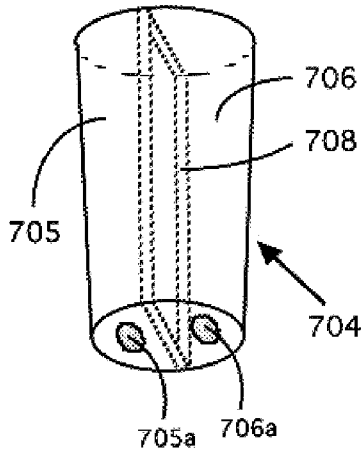

DEVICE FOR MAINTAINING SEPARATE INGREDIENTS IN LIQUID FOOD PRODUCTS

This application is a continuation-in-part of U.S. Pat. application No. 09/321,676, of the same title, by the same inventor, filed on May 28, 1999.

TECHNICAL FIELD

This invention generally relates to a device for maintaining ingredients separate in liquid food products until the time of use, and more particularly, to such improvements as used with standard beverage bottles or cans.

BACKGROUND OF INVENTION

In the storage of liquid foodstuffs, and particularly beverages, the food product can have better flavor, have a longer shelf life, be made without preservatives, and/or can use less stable or unstable ingredients if certain of the ingredients can be stored separately from the carrier liquid until the food product is to be consumed. For example, a beverage can have better taste if the flavoring can be stored in dry form and mixed with the carrier liquid just prior to use. Some flavorings, oils, vitamins, supplements, medicines, and other ingredients when mixed with water, soda, or other liquid media are unstable, and therefore may not be used with currently sold beverages and liquid mixtures. Oxygenated water is known to have health benefits but is chemically reactive, and therefore flavors, vitamins, supplements, and pharmaceuticals cannot be combined with it in a stored product. Many beverages, sauces, and condiments require high levels of preservatives to control fermentation with sugar content.

Prior devices have been proposed for storing ingredients separately from the carrier liquid until the product is to be used, however they have a number of disadvantages. Some devices, as shown in U.S. Pat. Nos. 3,779,372, 5,529,179, 5,431,276, and 5,885,635, for example, have a burstable compartment attached to the underside of the container lid or cap which is burst open to mix ingredients into the carrier liquid by levering a puncturing tab or depressing a plunger element with an applied pressure. However, these devices may be unsafe or messy to use since a high applied pressure must be used to burst open the compartment, and may cause the ingredients spew out of the container or back toward the user.

Other devices, such as shown in U.S. Pat. Nos. 3,179,275 3,225,915, or 5,064,073, for example, have a sub-compartment formed in the container top or held in the container neck with can be accessed by removing an outer seal strip, flap, or membrane. However, these devices are not suitable for the current vending machine environment, since the outer sealing member can become accidentally dislodged or punctured during transport or handling.

Some devices, such as shown in U.S. Pat. Nos. 4,024,952, 4,221,291 and 4,264,007, for example, have one or more sub-compartments formed inside the container on the underside of the container lid or cap which have a tilting or gate type element that is actuated by releasing or applying pressure to a component from the outside of the container lid or cap. These types of devices have the disadvantage that the ingredients are completely discharged into the liquid upon release, and cannot be metered or controllably added to the liquid according to the tastes of the user.

Another device, such as shown in U.S. Pat. No. 5,114,011, for example, has a removable sub-container with removable seal which rests in the container neck covered by the container cap until it is ready to be used. However, this type of device has only a single compartment and does not have provision for easily metering ingredients into the container after the seal is opened.

Other types of devices, as shown in U.S. Pat. No. 5,114,011, for example, have a sub-container formed with one or more sub-compartments which is mounted to the underside of the container cap. However, the sub-compartments in these devices are disposed at opposite ends of the sub-container element and are opened by threaded elements, thereby making them costly to fabricate and awkward to use.

SUMMARY OF INVENTION

The present invention seeks to overcome the disadvantages and shortcomings of the prior devices by providing improved structures for holding ingredients separately within a container which is inexpensive to manufacture, convenient and easy to use, and prevents accidental unsealing or release during shipping or handling.

In accordance with the present invention, a device for use with a container having a removable container cap comprises a sub-container body having means for removably mounting it in the container beneath the container cap, said sub-container body being formed with squeezable plastic outer walls and at least one inner divider wall dividing the interior of the sub-container body into a plurality of compartments, wherein each compartment has a respective dispensing orifice, and an ingredient contained in the respective compartment is controllably dispensed through the orifice by squeezing on a part of the squeezable plastic outer walls corresponding to the compartment.

In a first embodiment of the invention, the device has a sub-container body in cylindrical form having a proximate end mounted to an underside of the container cap, and at least one inner divider wall aligned in parallel with a cylinder axis of the sub-container body dividing the interior of the sub-container body into a plurality of axially oriented compartments, wherein each compartment has a dispensing orifice formed at a distal end of the sub-container body and an ingredient contained in the compartment is controllably dispensed through the orifice by squeezing on a part of the squeezable plastic outer walls corresponding to the compartment.

In a second embodiment, the device comprises a sub-container body in cylindrical form having a proximate end detachably mounted to an underside of the container cap, and at least one inner divider wall aligned in parallel with a cylinder axis of the sub-container body dividing the interior of the sub-container body into a plurality of axially oriented compartments, wherein each compartment has a dispensing orifice formed at the proximate end of the sub-container body and an ingredient contained in the compartment is controllably dispensed through the orifice by detaching the proximate end of the sub-container body from the container cap and squeezing on a part of the squeezable plastic outer walls corresponding to the compartment.

In a third embodiment, the device comprises a sub-container body in cylindrical form having a proximate end mounted to a collar adapted to be held on a neck of the container by the container cap, said sub-container body having at least one inner divider wall aligned in parallel with a cylinder axis of the sub-container body dividing the interior of the sub-container body into a plurality of axially oriented compartments, wherein each compartment has a dispensing orifice formed at a distal end of the sub-container body and an ingredient contained in the compartment is controllably dispensed through the orifice by removing the sub-container body from the container neck and squeezing on a part of the squeezable plastic outer walls corresponding to the compartment.

In the above-described embodiments, predetermined portions of the squeezable plastic outer walls corresponding to the respective compartments are formed with an area of lesser wall thickness than that of surrounding portions of the outer walls, such that the thinner wall areas can be squeezed more readily to dispense ingredients from the respective compartments.

In a fourth embodiment, the device comprises a sub-container body in cylindrical form having a proximate end mounted to an underside of the container cap, and at least one inner divider wall aligned transverse to a cylinder axis of the sub-container body dividing the interior of the sub-container body into a plurality of transversely oriented compartments, wherein each compartment has a dispensing orifice formed at a predetermined position of the outer walls and an ingredient contained in the compartment is controllably dispensed through the orifice by squeezing on a part of the outer walls corresponding to the compartment opposite from the orifice.

In accordance with a fifth embodiment of the invention for use with a container having a fixed container top and a pull-tab with a pull portion, a tab portion removably covering a tab opening in the container top, and a center fixture detachably mounted to an outer surface of the container top, the device comprises the container top being formed with a plurality of exterior wells positioned on radially spaced sides from the pull tab and recessed into the outer surface of the container top, said exterior wells having respective sub-container vessels of matching shape carried therein with upper surfaces thereof disposed evenly with the outer surface of the container top, each said sub-container vessel having a radially inward portion thereof being held and protected by the pull tab in its unremoved position, wherein when the pull tab is removed from the container top the sub-container vessels can be removed from their respective exterior wells for dispensing of their respective ingredients.

In a sixth embodiment, the device comprises the container top being formed with an exterior well positioned on a radially spaced side from the pull tab and recessed below the outer surface of the container top, said exterior well having a sub-container vessel of matching shape carried therein with an upper surface thereof disposed evenly with the outer surface of the container top, said sub-container vessel being divided into a plurality of compartments each having a dispensing orifice for dispensing a respective ingredient therefrom, said sub-container vessel having a radially inward portion thereof being held and protected by the pull tab in its unremoved position, wherein when the pull tab is removed from the container top the sub-container vessel can be removed from the exterior well for dispensing of the ingredients from the respective compartments.

In a seventh embodiment, the device comprises a sub-container body in cylindrical form, removably mounted in a neck of the container and covered by the container cap, having a proximate end with inclined walls leading to a central opening and an annular flange adjacent the inclined walls, such that when the sub-container body is removed from the container neck, the proximate end can be inserted into the neck opening until the annular flange abuts the neck rim, whereby ingredients contained in the sub-container body can be dispensed into the container without risk of spilling or splashing outside the container. The sub-container body may be mounted to the underside of the container cap, or held by its annular flange between the cap and the rim of the container neck. The inclined walls and annular flange serve to guide the proximate end positively into the neck opening and be held securely in place.

In an eighth embodiment, the device comprises a sub-container body in cylindrical form, removably mounted in the container neck and covered by the container cap, having a proximate end with inclined walls leading to a central opening, an annular flange adjacent the inclined walls, and an inner wall parallel to its cylindrical axis dividing the interior of the sub-container body into a plurality of axially oriented compartments, wherein each compartment is formed with a dispensing orifice at the proximate end of the sub-container body, each orifice being separately sealed, such that when the sub-container body is removed from the container neck and one or more of the compartment orifices is selectively unsealed, the proximate end can be inserted into an opening in the container neck with the annular flange abutting an upper rim of the neck, whereby ingredients contained in the selected compartments can be dispensed into the container without risk of spilling or splashing outside the container.

In a ninth embodiment, the device comprises a sub-container body in cylindrical form which is removably mounted in the container neck and covered by the container cap, having a proximate end provided with an annular flange fixed to its outer surface and screw threads formed on the outer surface of the proximate end on an upper side of the annular flange, the container neck having complementary inner threads on an inner surface recessed in the neck opening, such that when the sub-container body is removed from the container neck, the proximate end of the sub-container body can be inserted in and threaded to the inner surface of the container neck until its annular flange abuts the rim of the neck, whereby ingredients in the sub-container body can be dispensed by shaking or mixing with fluid in the container without risk of spilling or splashing outside the container. The outer threading of the sub-container body and inner threading of the container neck and the annular flange allow the parts to be securely held together. Sealing films may be provided on upper and lower sides of the annular flange.

In a tenth embodiment, the device comprises a sub-container body in cylindrical form which is removably mounted in the container neck and covered by the container cap, said sub-container body having a proximate end with an annular flange fixed to its outer surface and screw threads formed on the outer surface of the proximate end on an upper side of the annular flange, the container neck having complementary inner threads on an inner surface recessed in the neck opening, the sub-container body having an inner wall parallel to its cylindrical axis dividing the interior of the sub-container body into a plurality of axially oriented compartments, wherein each compartment is formed with a dispensing orifice at the proximate end of the sub-container body, each orifice being separately sealed such that when the sub-container body is removed from the container neck, one or more of the compartment orifices can be selectively unsealed, and the proximate end of the sub-container body can be inserted into and threaded to the inner surface of the container neck until the annular flange abuts with the neck rim, whereby ingredients in the unsealed compartments can be dispensed by shaking or mixing with fluid in the container without risk of spilling or splashing outside the container. The plurality of compartments and separately sealed orifices allow different ingredients to be selectively dispensed in the container. Sealing films may be provided on upper and lower surfaces of the annular flange.

In an eleventh embodiment, the device comprises a sub-container body in cylindrical form which is integrally formed with the container cap so as to be removably mounted in the container neck, said sub-container body having a hollow interior therein which is covered by an outer flap, and having a proximate end provided with an annular flange which is connected to a depending flange for the container cap having screw threads formed on its inner surface facing inwardly for engagement with screw threads on an outer surface of the container neck. The hollow interior of the sub-container body may be used to hold a single or multi-compartment container therein, or to hold other objects such as capsules or prizes.

In a twelfth embodiment, the device comprises a sub-container body in annular ring form which is mounted between inner and outer depending annular flanges of the container cap, said container cap having an inner bore provided with screw threads on an inner surface thereof facing inwardly for engagement with screw threads formed on an outer surface of the container neck, wherein said sub-container body in annular ring form has at least one compartment formed therein for holding separate ingredients which is provided with a dispensing orifice for dispensing the ingredients into the container neck. The sub-container body may have multiple compartments distributed around its annular ring form.

With these improved devices, multiple ingredients can be safely stored separately from the carrier liquid and conveniently used and selectively dispensed into the container according to the user's tastes. Thus, a wide range of new liquid food products can be provided with better flavor, longer shelf life, and using otherwise unstable ingredients, and without any or with reduced amounts of preservatives.

Other objects, features, and advantages of the present invention will be explained in the following detailed description of the invention having reference to the appended drawings.

BRIEF DESCRIPTION OF DRAWINGS

FIGS. 7A through 7H illustrate a sixth embodiment of the invention having a sub-container vessel with multiple compartments held in an exterior well recessed in the outer surface of a fixed container top, which is held in place and protected by a container pull-tab.

DETAILED DESCRIPTION OF INVENTION

Figure 1A:
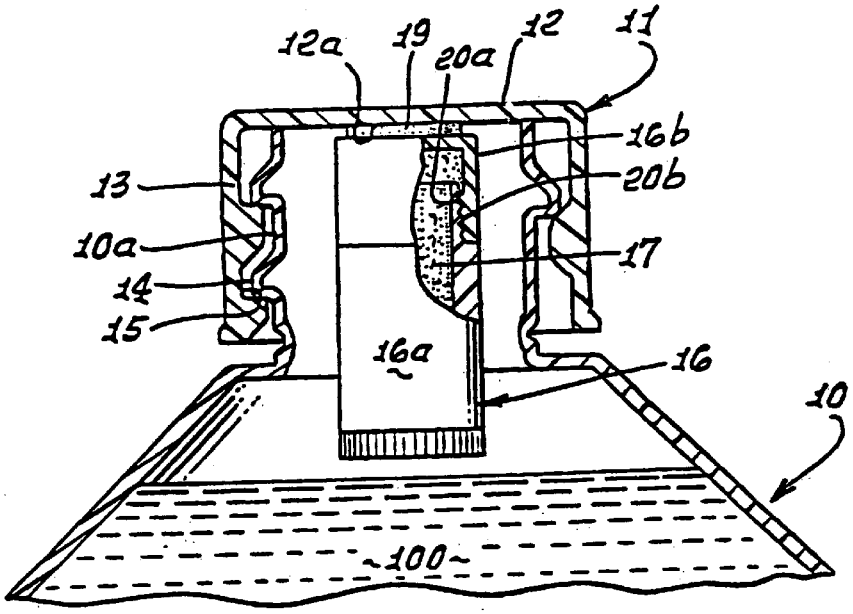
FIG. 1A (PRIOR ART)
FIGS. 1A and 1B illustrate two versions of a prior art device having a sub-container body with one or two compartments mounted to a container cap or held on a container neck by the container cap.
Figure 1B:
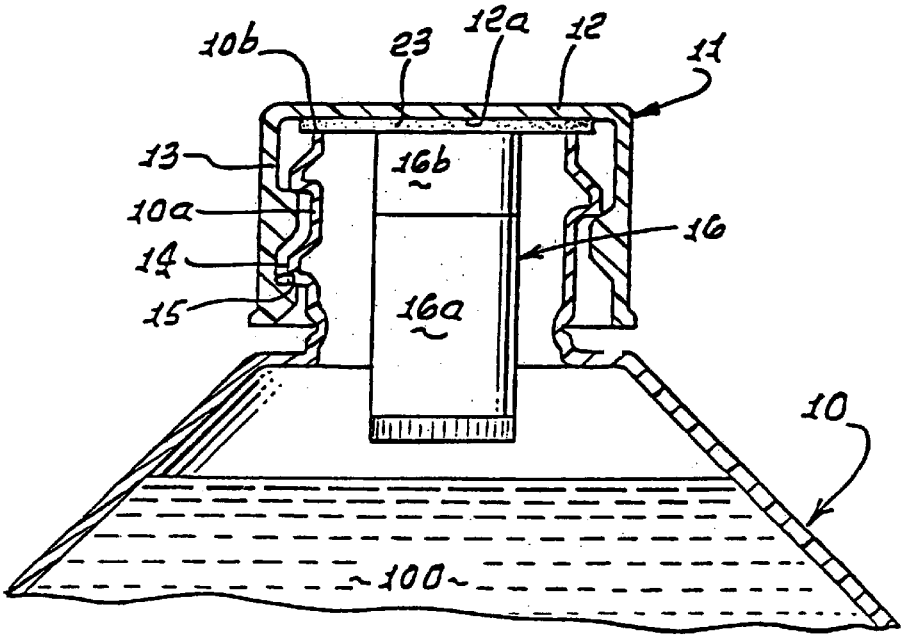
FIG. 1B (PRIOR ART)

A broad objective of the present invention is to overcome the disadvantages of the prior art devices, as represented in FIGS. 1A and 1B. In FIG. 1A, a container 10 holding a liquid 100 has a neck 10*a* and a cap 11 with upper wall 12 and depending skirt 13. The cap is applied on the neck to close the container by threading the inter-engaging threads 14 and 15. A rigid sub-container 16 has a lower portion 16*a* containing a dry ingredient 17 that is held, through inter-engaging threads 20*a* and 20*b*, to an upper closure portion 16*b* fixed to the underside 12*a* of the cap 11 by an adhesive layer 19. When the cap is removed from the container, the lower portion 16*a* of the sub-container body can be un-threaded from the fixed upper portion 16*a* and its ingredient can be dispensed into the liquid 100. In another version shown in FIG. 1B, the sub-container body 16 is held on the cap on the container neck suspended by a collar 23, and has separate compartments 16*a* and 16*b* which are opened by unthreading them from each other. This type of prior art device is costly to manufacture and inconvenient to use.

In accordance with one principal approach in the present invention, a device for storing ingredients separately within a container has a sub-container body held by a container cap, such as is commonly used for a beverage bottle, which has squeezable plastic outer walls and inner divider walls forming multiple compartments with respective orifices for dispensing ingredients contained therein. Each compartment can be separately opened (by removing a sealing element)

and its ingredient can be dispensed into the container by squeezing on corresponding portions of the outer walls. Four embodiments of this approach are described below.

In another principal approach, the device has a plurality of sub-container vessels or a single vessel with multiple compartments held in exterior well(s) recessed in a fixed container top, such as is commonly used for a beverage can. The sub-container vessels are held in place by and protected by the pull tab on the container top. When the pull tab is removed and the tab opening is exposed, the sub-container vessels can be removed from the exterior wells to dispense their separate ingredients into the container. Two embodiments of this approach are described below.

Figure 2A:
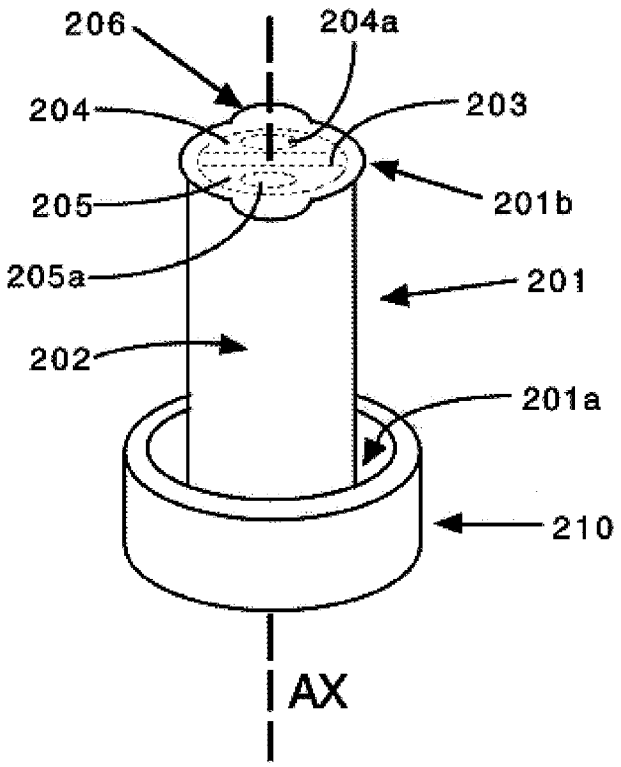
FIGS. 2A through 2G illustrate a first embodiment of the invention having a multi-compartment sub-container body with squeezable plastic, outer cylindrical walls, which is mounted to the container cap.
Figure 2B:
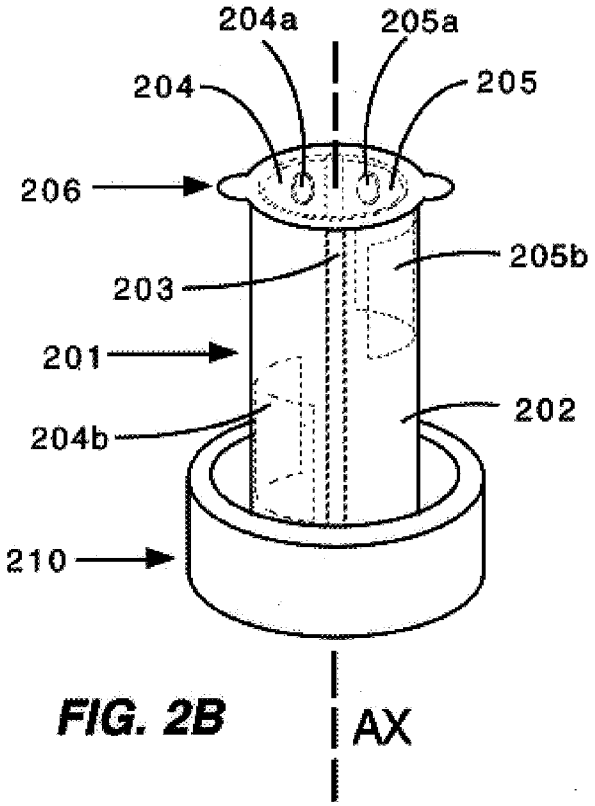

Referring to FIGS. 2A and 2B, a first embodiment of the device for use with a bottle container has a sub-container body 201 in cylindrical form with a proximate end 201*a* mounted to the underside of the container cap 210. The sub-container body 201 has squeezable plastic outer walls 202 and at least one inner divider wall 203 which is aligned in parallel with a cylinder axis AX of the sub-container body. The divider wall 203 divides the interior of the sub-container body into two axially oriented compartments 204, 205. A greater number of compartments can be formed by using more than one divider wall.

The compartments 204, 205 are used to contain respective flavorings, oils, vitamins, supplements, medicines, and other ingredients to be mixed in the carrier liquid at the time of use. The compartments have respective dispensing orifices 204*a* and 205*a* formed through closure walls at the distal end 201*b* of the sub-container body. The orifices of the individual compartments are sealed with individual adhesive foil tabs 204*c* and 205*c*. The distal end of the sub-container body 201 is sealed by a removable adhesive film membrane 206 with pull tabs to protect the foil tabs covering the orifices.

Figure 2C:
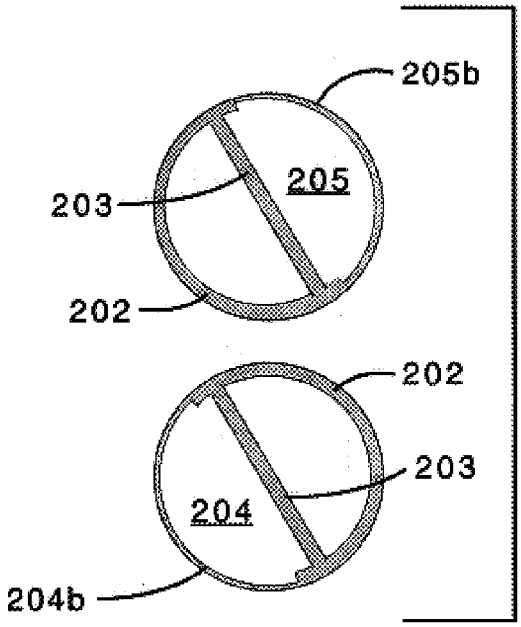

As shown in FIGS. 2B and 2C, predetermined portions 204*b* and 205*b* of the outer cylindrical walls 202 corresponding to the respective compartments are formed with a lesser wall thickness than the surrounding wall portions. The thinner wall areas can be squeezed more readily to dispense ingredients contained in the respective compartments, as illustrated in FIG. 2G. the combination of a readily manipulable squeezing area and dispensing orifice allows the user to controllably dispense the ingredient from the respective compartment.

Figure 2D:
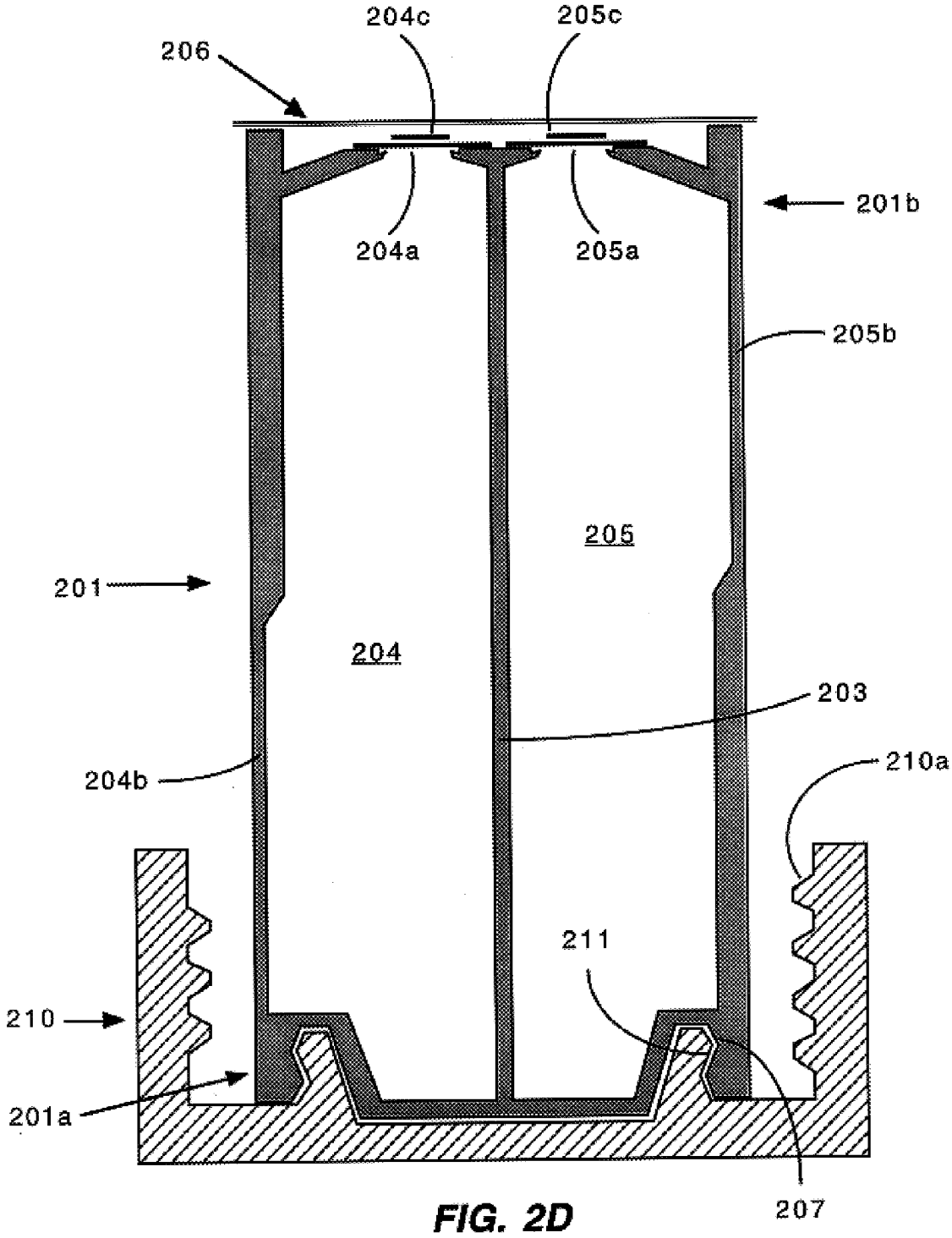
Figure 2E:
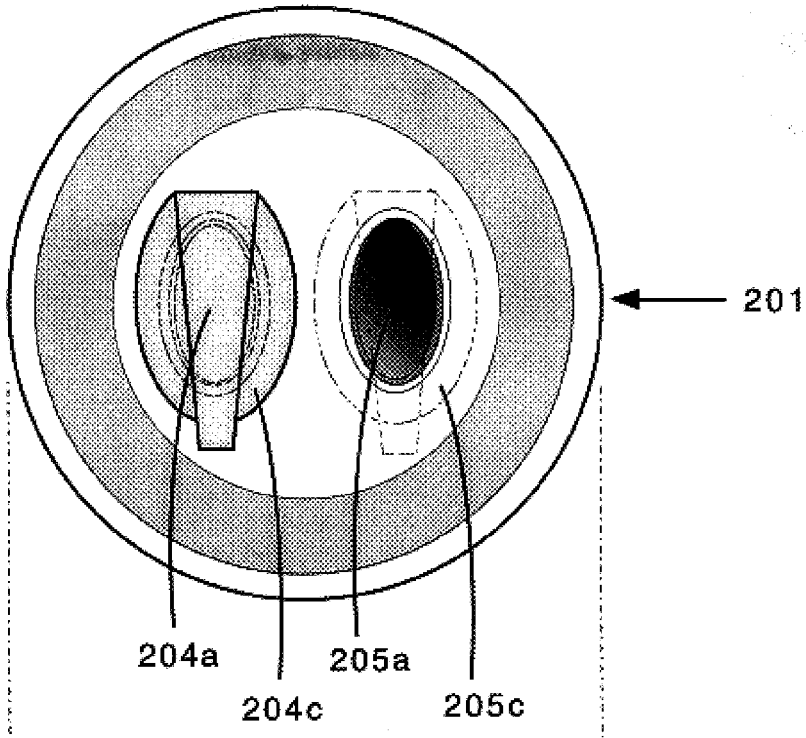
Figure 2F:
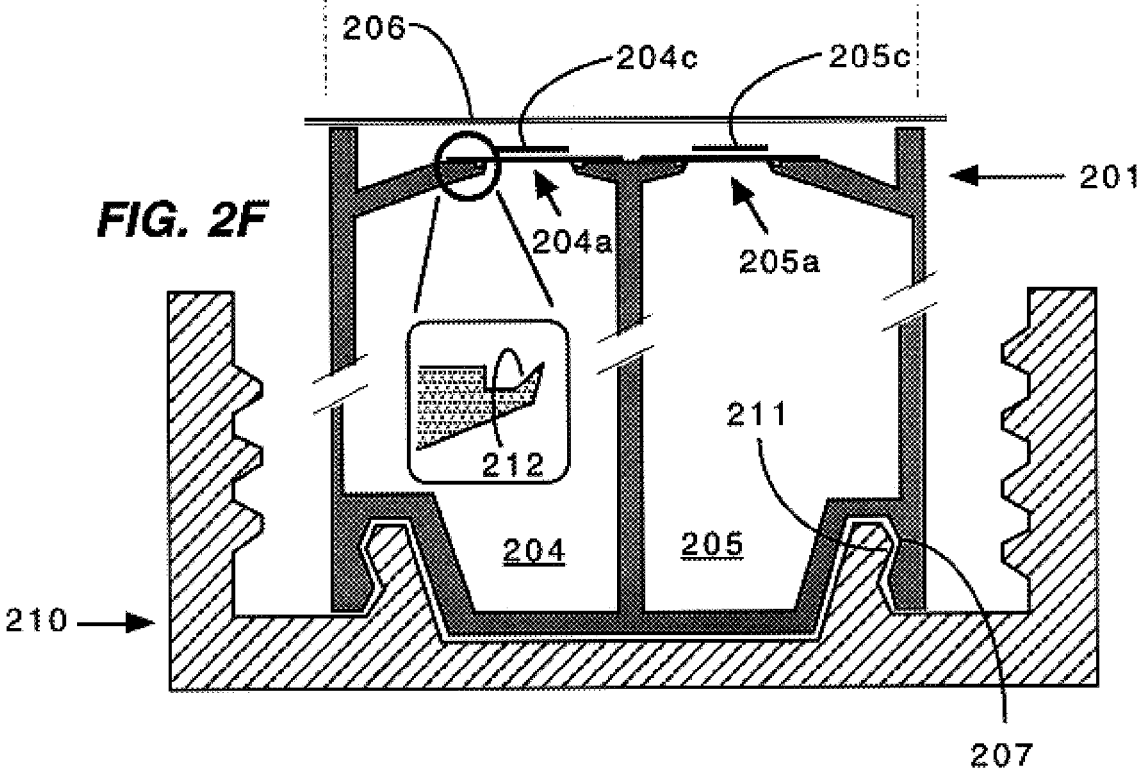
Figure 2G:
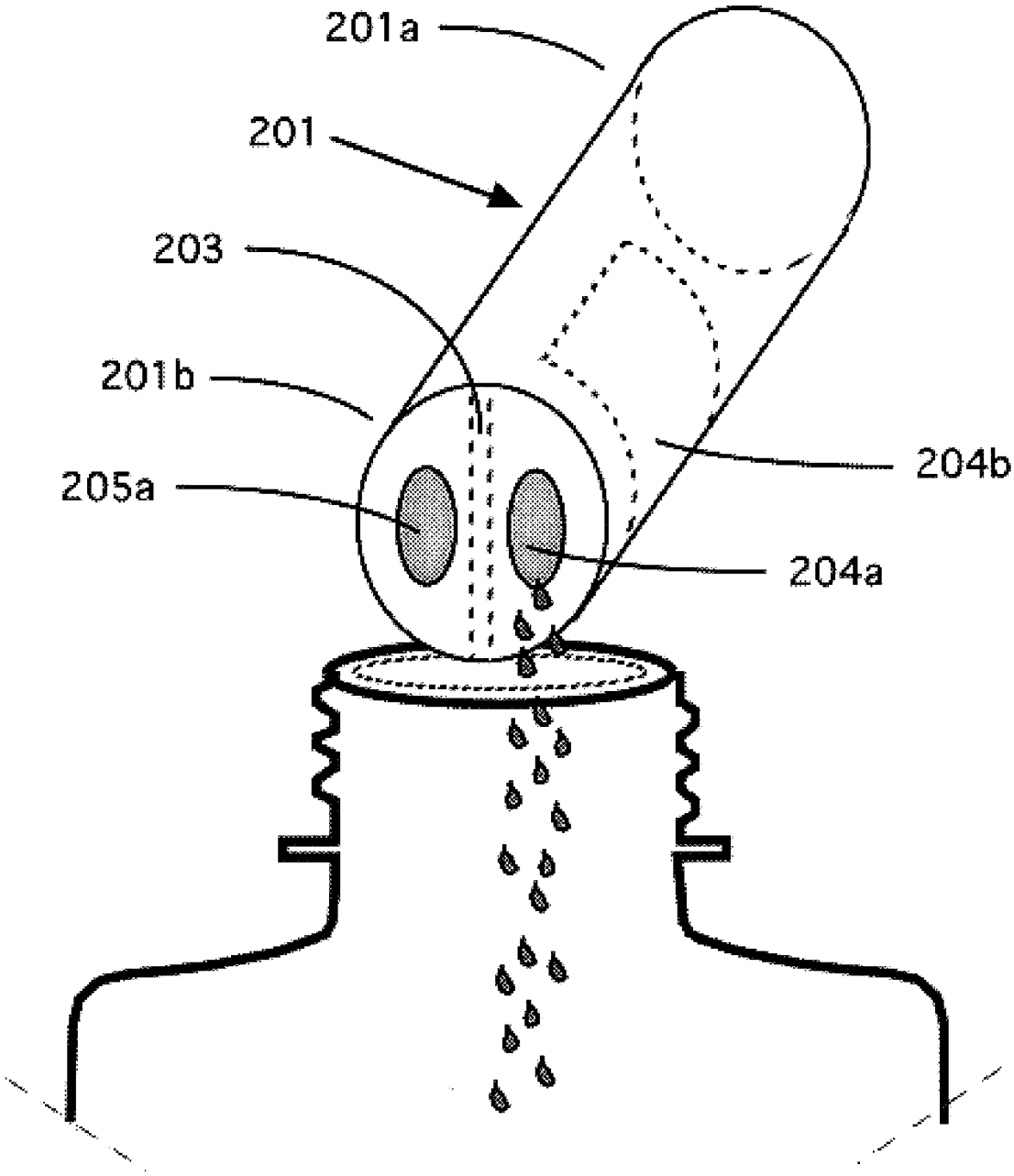

In further details shown in FIGS. 2D, 2E, and 2F, the sub-container body 201 is mounted at its proximate end 201*b* to the underside of the cap 210, which may be accomplished by any suitable means. In this embodiment, the sub-container body has a indented portion 207 with a detent surface and the cap 210 has a projection 211 with a detent-engaging surface for snap-fitting the sub-container body to the cap. This allows the parts to be molded separately, and also gives the user the option of removing the sub-container body from the cap to dispense ingredients and/or to reclose the cap. The cap 210 has threads 210*a* for threading on the neck of the container. The orifices 204*a* and 205*a* are sealed with individual foil tabs 204*c* and 205*c*. The annular edges of the orifices 204*a* and 205*a* may be provided with anti-drip indentations 212 which hold back any residue ingredient drips after pressure on the compartment is released.

The sub-container body can be made of clear polyvinylchloride (PVC), polypropylene (PP), or other suitable plastic material that is durable and has sufficient flexibility to allow it to be elastically squeezed. Typical overall wall thickness is in the range of about 0.50 mm, and about 0.20 mm for the thinner-walled portions. The dimensions of the sub-container body may be varied depending on the size of the cap, container, and desired holding capacity for the ingredients. For a bottle cap of typical 35 mm diameter, the sub-container body can have a diameter of about 22 mm. The orifice preferably have an elliptical shape with dimensions of about 3 mm by 5 mm.

Figure 3A:
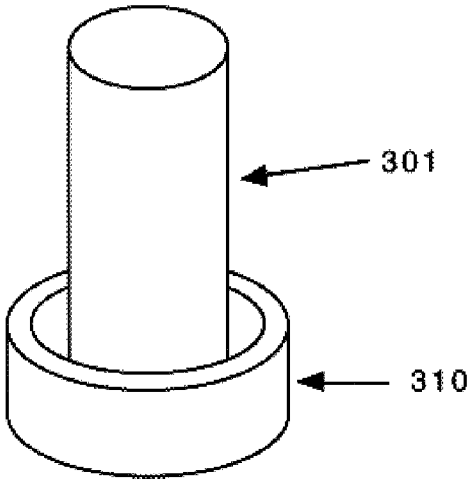
FIGS. 3A through 3E illustrate a second embodiment of the invention having a multi-compartment sub-container body with squeezable plastic, outer cylindrical walls, which is detachably removable from the container cap.
Figure 3B:
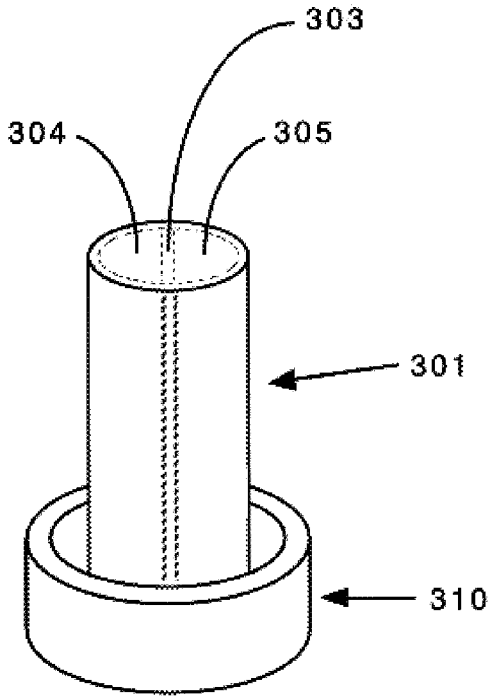
Figure 3C:
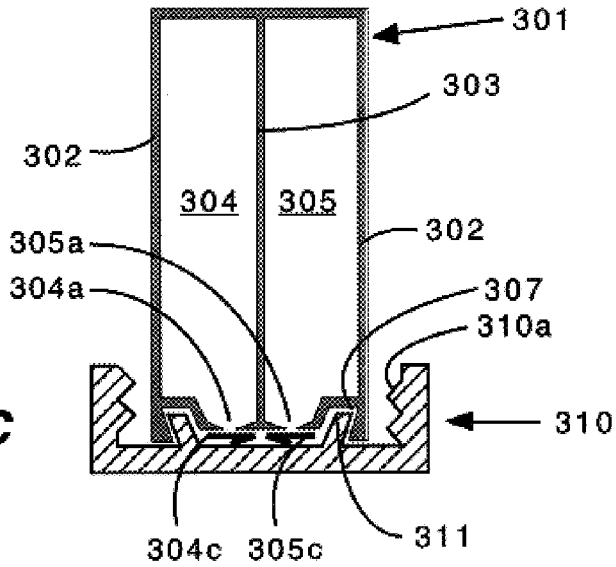
Figure 3D:
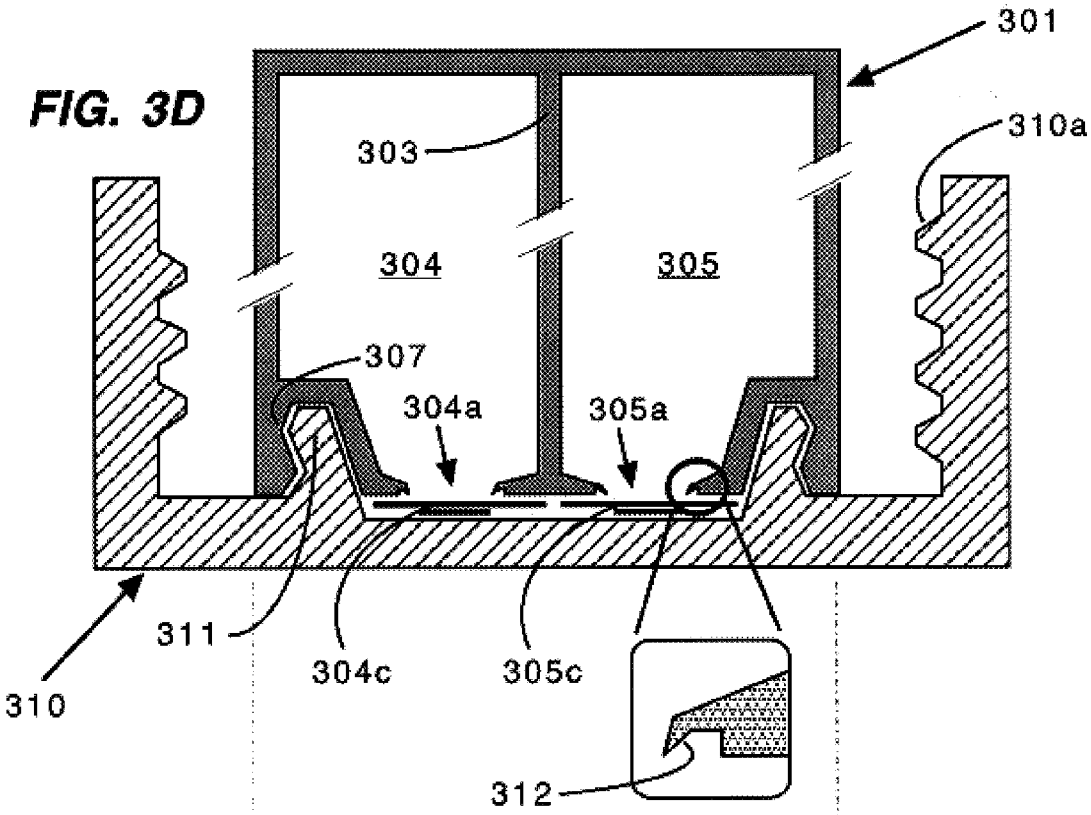
Figure 3E:
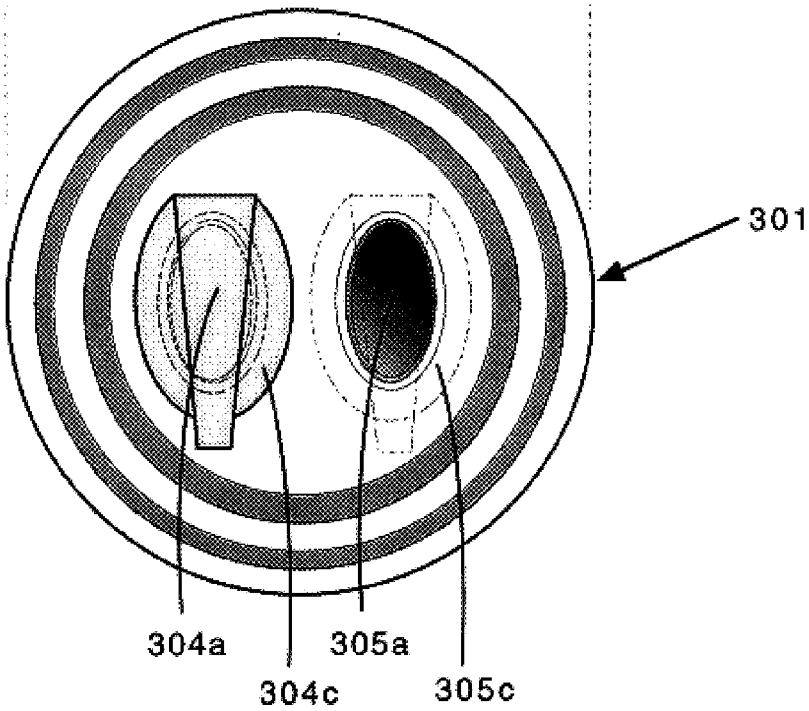

In FIGS. 3A, 3B, and 3C, a second embodiment of the device is shown having a cylindrical sub-container body 301 with its proximate end detachably mounted to the underside of the container cap 310 by detent surfaces 307 snap-fitted onto projections 311 on the underside of the cap. The sub-container body 301 has squeezable plastic outer walls 302. The divider wall 303 divides the interior of the sub-container body 301 into compartments 304 and 305. The compartments 304 and 305 have respective dispensing orifices 304*a* and 305*a* formed at the proximate end of the sub-container body. As shown in more detail in FIGS. 3D and 3E, the orifices are sealed with removable sealing tabs 304*c* and 305*c*, and have anti-drip edges 312. In this embodiment, positioning the compartment orifices at the proximate end keeps them away from the carrier liquid and reduces the possibility of seepage or liquid penetration into the seals.

Figure 4A:
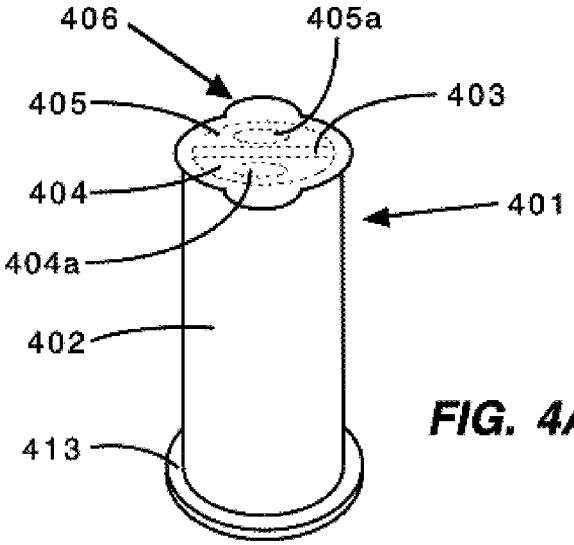
FIGS. 4A through 4F illustrate a third embodiment of the invention having a multi-compartment sub-container body with squeezable plastic, outer cylindrical walls, which is mounted by the container cap on a container neck.
Figure 4B:
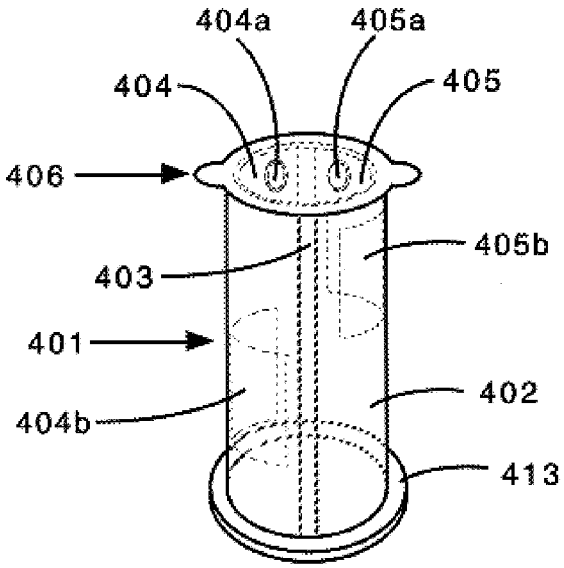
Figure 4C:
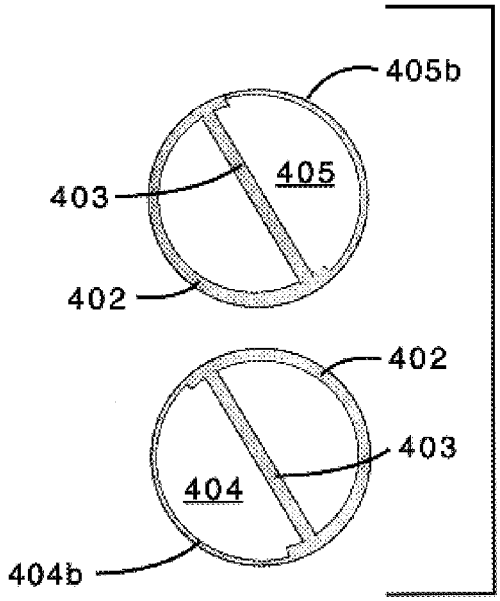
Figure 4D:
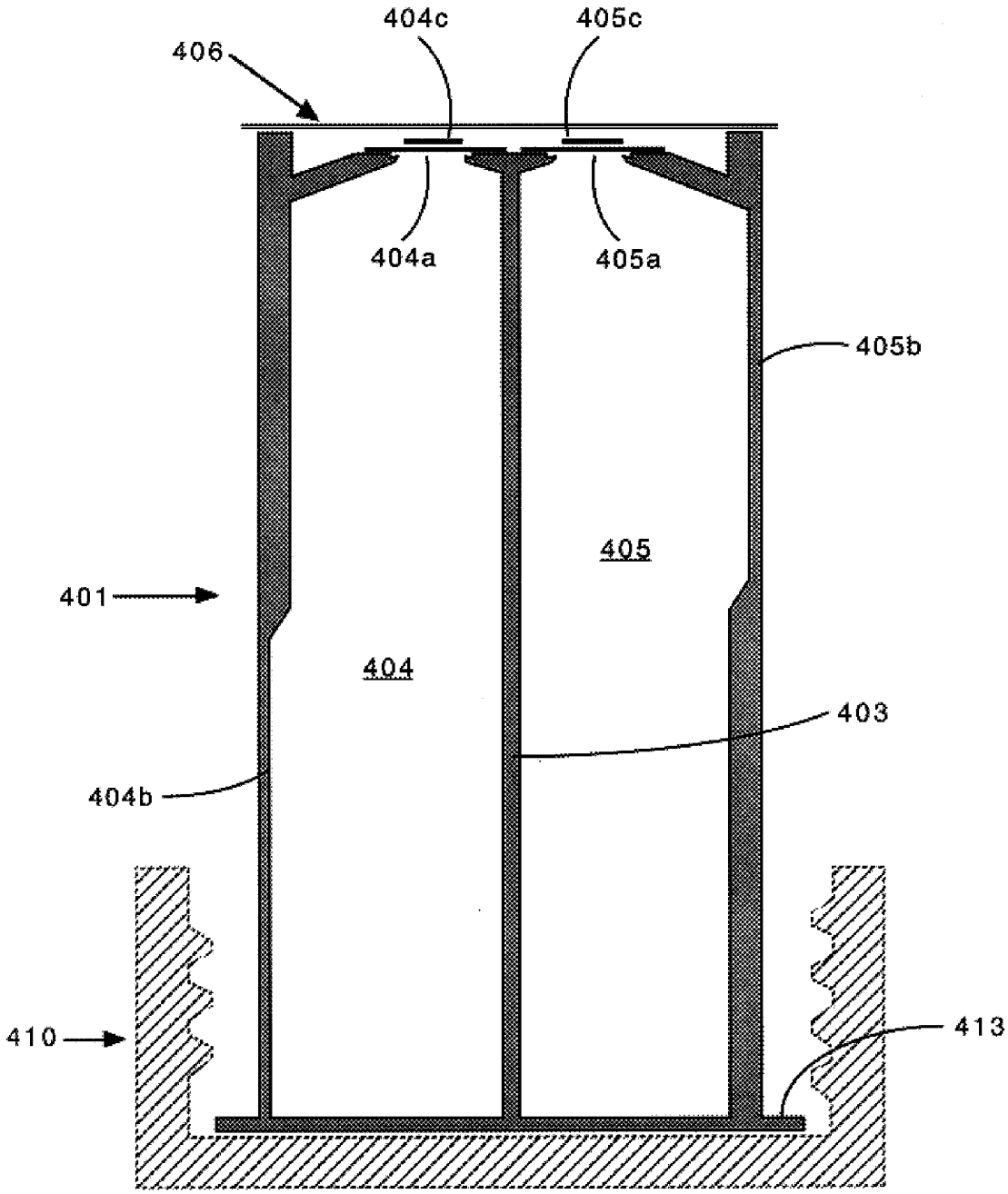
Figure 4E:
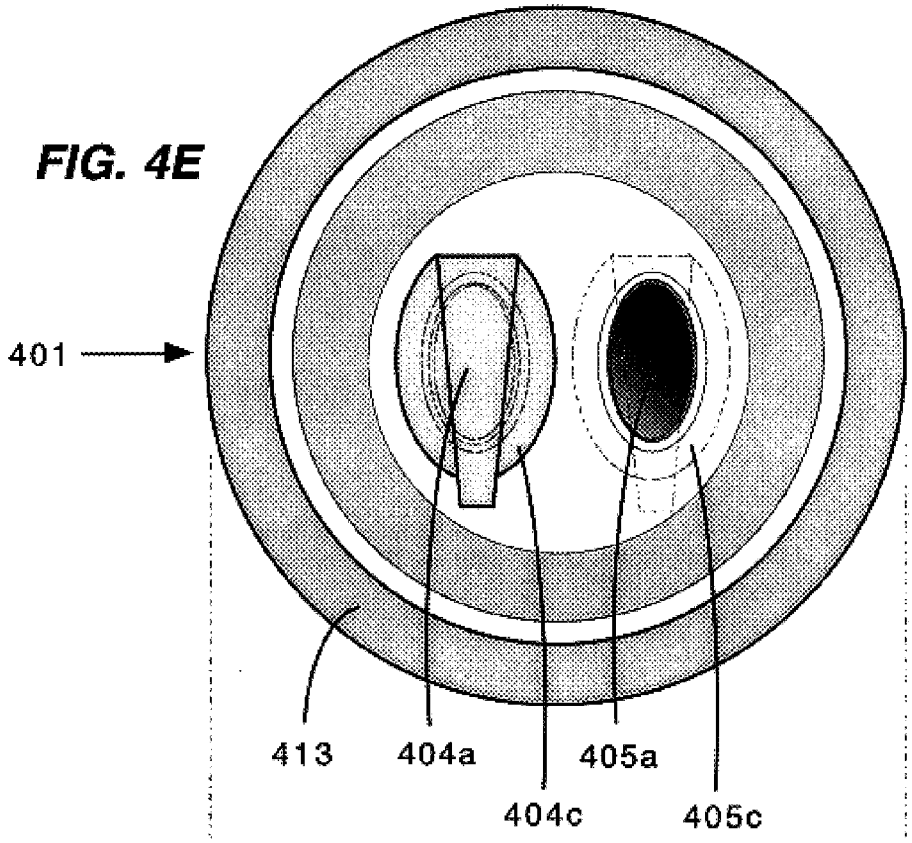
Figure 4F:
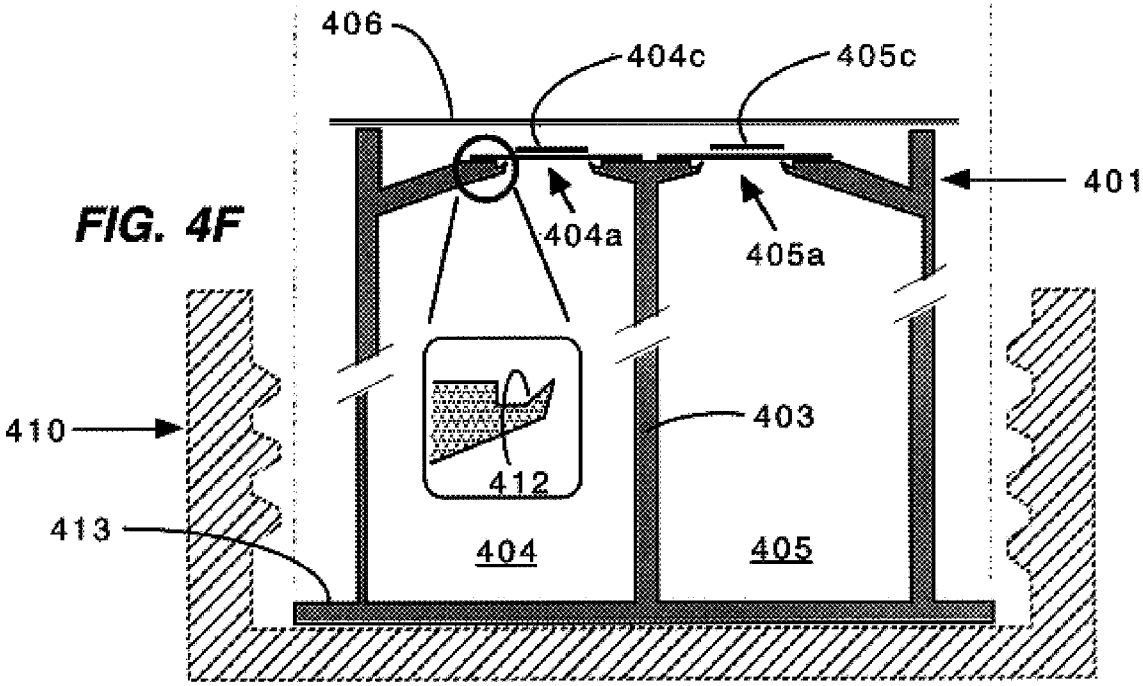

In FIGS. 4A, 4B, and 4C, a third embodiment of the device, similar to the first embodiment, has a cylindrical sub-container body 401 formed with squeezable plastic outer walls 402, divider wall 403, compartments 404 and 405, respective orifices 404*a* and 405*a* at its distal end, and thin-walled squeeze portions 404*b* and 405*b*. In FIG. 4D, the sub-container body 401 is shown fixed to a collar 413 which is to be held on the container neck by the container cap 410 (in a manner similar to the prior art device of FIG. 1B). When the cap is removed from the container neck, the sub-container body 401 can be lifted out and the orifices 404*a* and 405*a* unsealed to dispense the respective ingredients. In FIGS. 4E and 4F, the orifices 404*a* and 405*a* for the compartments of the sub-container body 401 are shown having individual sealing tabs 404*c* and 405*c*, anti-drip edges 412, and outer sealing membrane 406.

The sub-container body 401 has a diameter which easily fits within the bottle neck opening, while the collar has a diameter large enough to fit within the inside of the cap and rest on the upper rim of the neck. The collar can be made of a rigid plastic such as high density polyethylene.

Figure 5A:
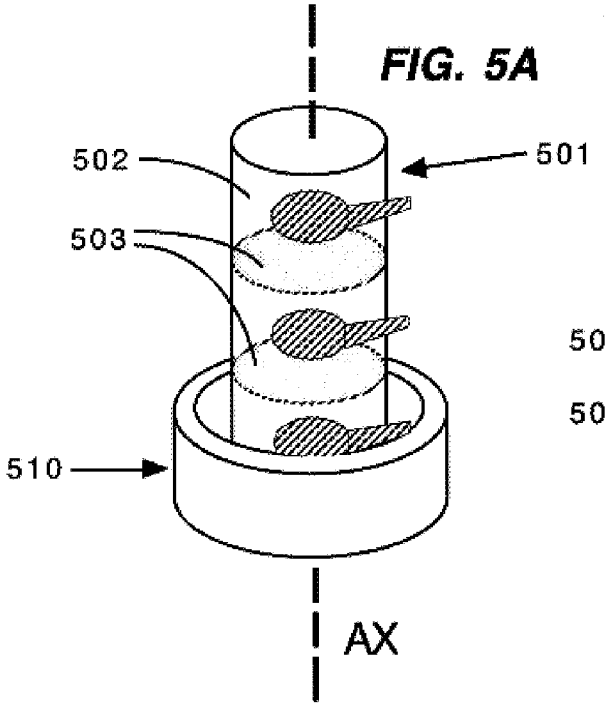
FIGS. 5A through 5G illustrate a fourth embodiment of the invention having a sub-container body with multiple compartments arranged transversely, which is mounted to the container cap.
Figure 5B:
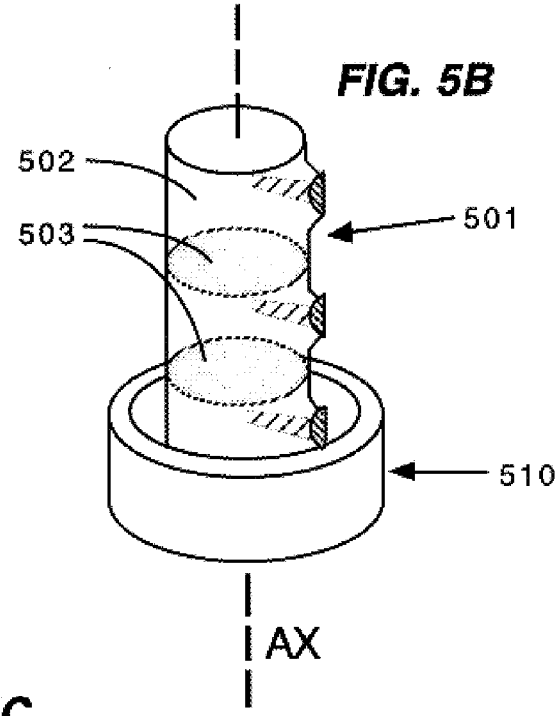
Figure 5C:
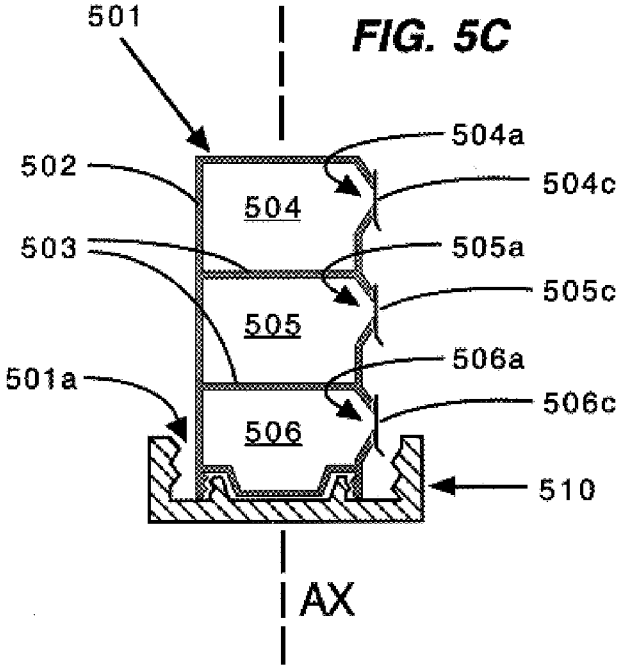

In FIGS. 5A, 5B, and 5C, a fourth embodiment of the device is shown having a sub-container body 501 in cylindrical form with its proximate end 501*a* mounted to the underside of the container cap 510. The sub-container body is formed with squeezable plastic outer walls 502, and has divider walls 503 aligned transverse to the cylinder axis AX dividing the interior of the sub-container body into a plurality of transversely oriented compartments 504, 505, and 506. The compartments have respective orifices 504*a*, 505*a*, and 506*a* formed at predetermined positions of the outer walls for each compartment.

Figure 5D:
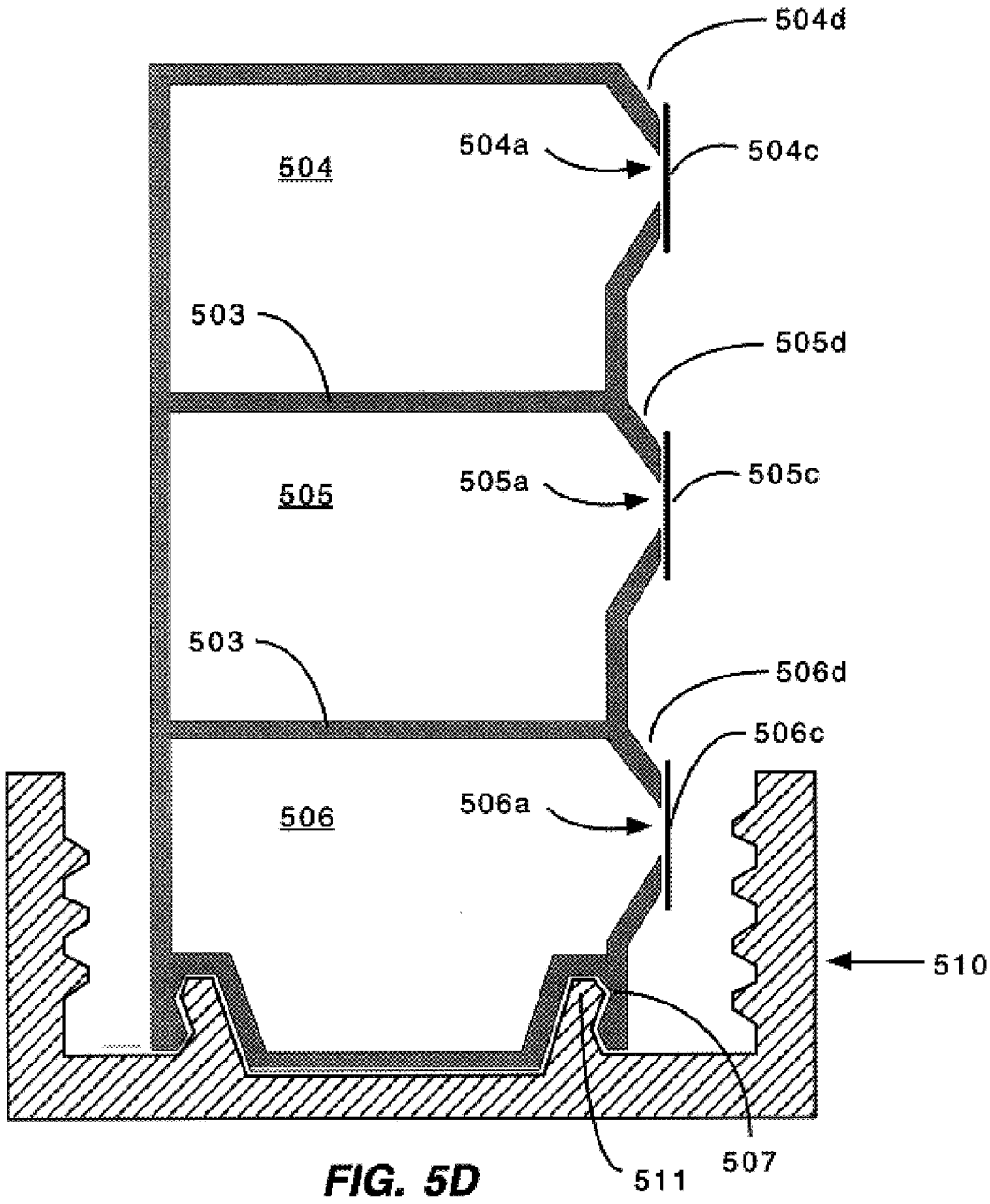
Figure 5E:
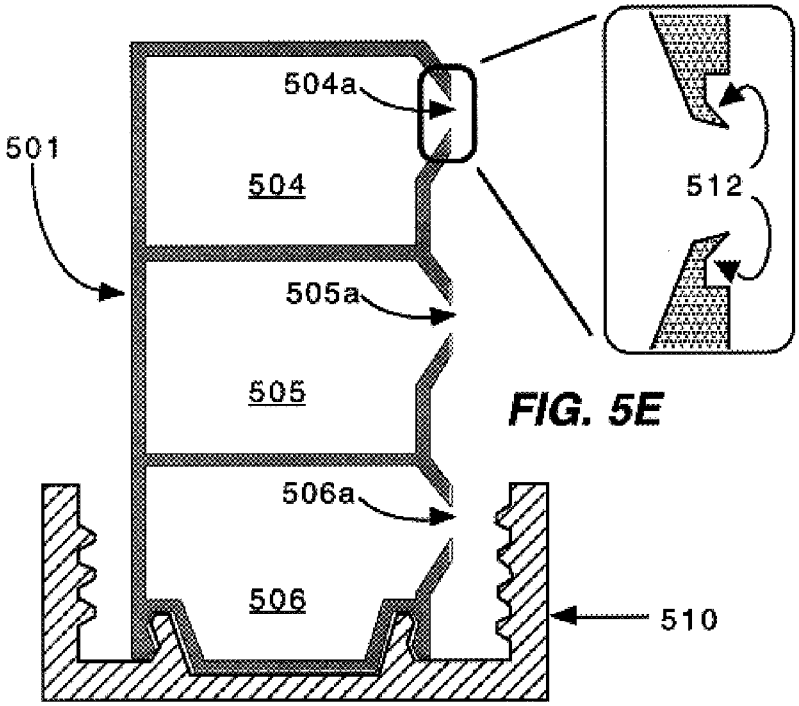
Figure 5F:
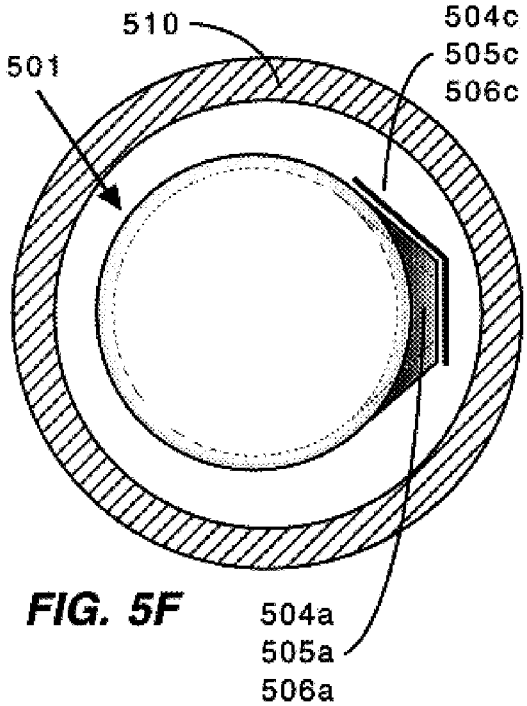
Figure 5G:
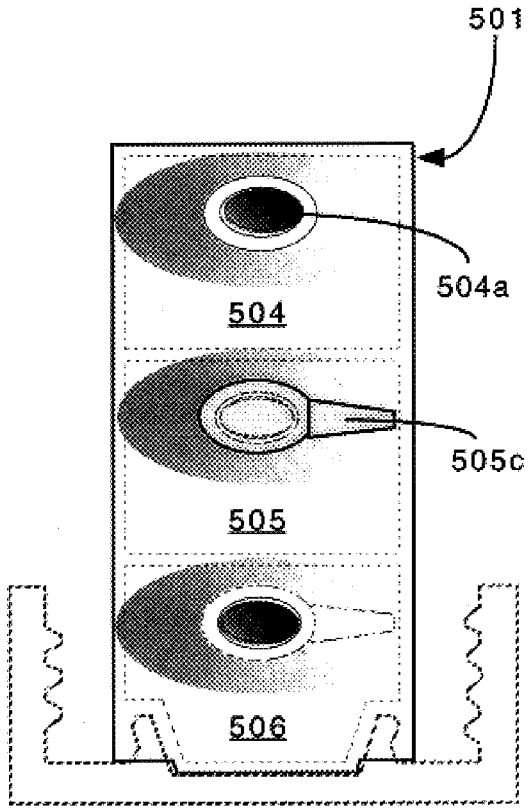

In FIG. 5D, the sub-container body 501 is shown in greater detail having an indented detent surfaces 507 to which projections 511 on the underside of the cap are snap-fitted to mount the sub-container body to the cap. The portions of the outer walls at the positions of the orifices can be formed with puckers 504*d*, 505*d*, and 506*d* for better directing of ingredients from the orifices under pressure. In FIG. 5E, the orifices 504*a*, 505*a*, and 506*a* are shown having anti-drip edges 512. FIGS. 5E, 5F, and 5G show in greater detail the orifices sealed by individual, removable sealing element 504*c*, 505*c*, and 506*c*.

The sub-container body in the three-compartment example described above can have typical dimensions of about 20 mm diameter (excluding the puckered areas around the orifices) and 45 mm length, resulting in each of the three compartments having about 4.7 cc capacity. The sub-container body may be formed with any desired number of separate compartments for the ingredients by providing the required number of divider walls. For an example where it is used for iced coffee beverage, it can have three divider walls forming four compartments to hold coffee flavoring, creamer, sugar, and synthetic sweetener.

Figure 6A:
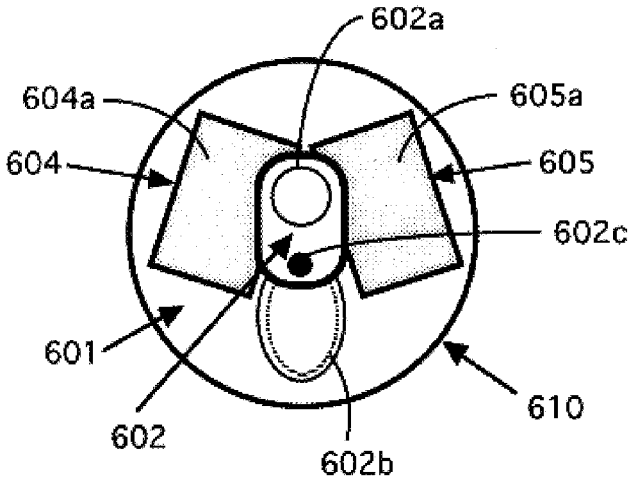
FIGS. 6A through 6D illustrate a fifth embodiment of the invention having multiple sub-container vessels held in exterior wells recessed in the outer surface of a fixed container top, which are held in place and protected by a container pull-tab.
Figure 6B:
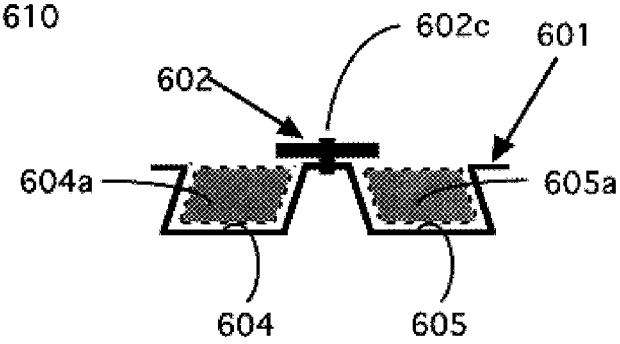
Figure 6C:
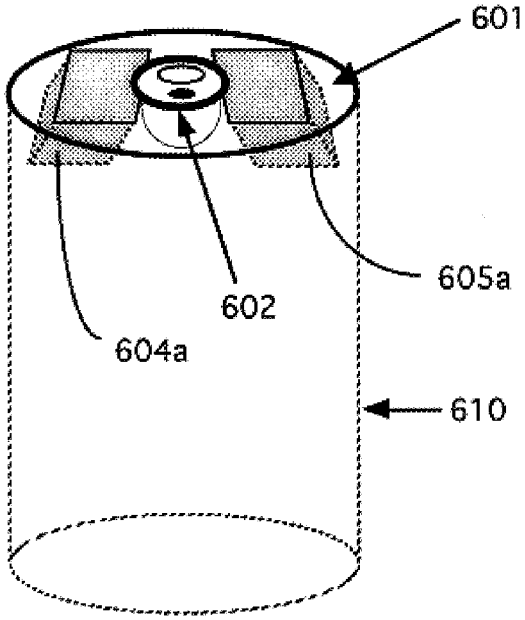

A fifth embodiment of the invention, as illustrated in FIGS. 6A, 6B, and 6C, is used with a container 610 with a fixed container top 601, such as for a beverage can. The container top 601 has an outer surface fitted with a pull-tab 602 having a pull portion 602*a*, a tab portion 602*b*, and a center fixture 602*c* which is detachably mounted to a center position on the outer surface of the container top. A tab opening formed in the container top is removably covered by the tab portion 602*b* of the pull-tab. Two (or more) exterior wells 604 and 605 are arranged at positions radially spaced from the pull tab 602 and are recessed below the outer surface of the container top 601.

Figure 6D:
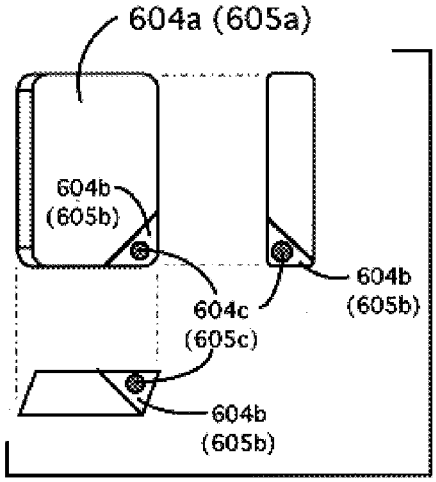

The exterior wells have respective sub-container vessels 604*a* and 605*a* of matching shape carried therein with their upper surfaces disposed evenly with the outer surface of the container top. FIG. 6D shows each sub-container vessel 504*a* (505*a*) having a dispensing orifice 604*c* sealed by a sealing element 604*b*. When the sub-container vessels are positioned in their exterior wells, a radially inward portion thereof is covered and held in place by a portion of the pull tab 602 in its unremoved position. When the pull tab is removed from the container top, the sub-container vessels can be removed from their respective exterior wells for dispensing of the respective ingredients into the container tab opening.

The sub-container vessels are formed with squeezable plastic outer walls, as previously described, to allow pressure to be applied to dispense the contents. For typical beverage cans having a can top of about 60 mm, the exterior wells can have a width of about 15 mm, spaced about 8 mm in the radial direction from the center position of the pull tab, a length of about 25 mm, and a depth of from 8 to 12 mm, resulting in each vessel having a capacity of about 3.7 to 4.0 cc. The interior walls of the exterior wells opposite their open end can be formed at varied depths to vary the volume of each of the wells. The walls of the exterior wells can be slanted towards the center position of the pull-tab to bias the vessels toward the pull tab and prevent them from being accidentally dislodged from the wells during handling.

In production on a form/fill/seal line, the container top is fabricated with the exterior wells press-formed therein, and with the tab portion scored in the tab opening and the mounting fixture for the pull portion riveted to the center of the top. The top is crimp-rolled onto the container body with the liquid media filled therein. The sub-container vessels can be inserted in the exterior wells by rotating the pull portion of the pull-tab about its center fixture to clear the openings of the wells. After the vessels are inserted therein, the pull portion is rotated back to its original position to overlap the openings of the wells and hold and protect the vessels therein. A protective paper, plastic, or nonwoven substrate may be placed over the container top and under the pull portion (usable also for printed advertising and by the user as an absorbent surface).

Figure 7F:
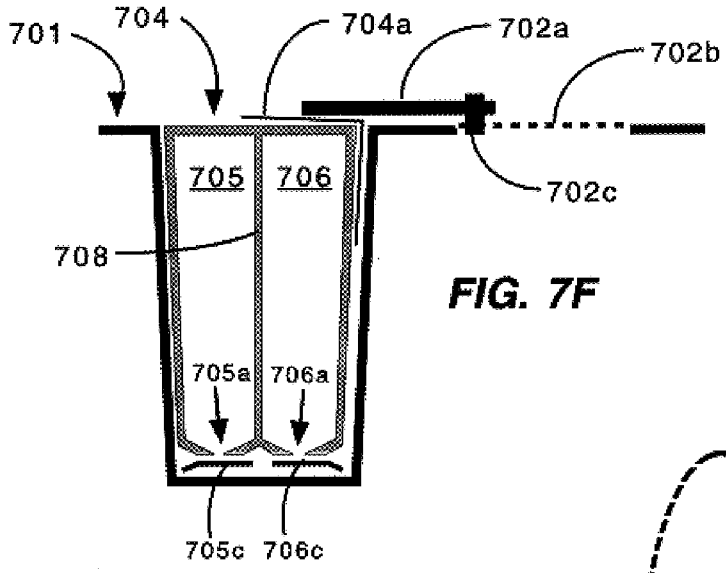
Figure 7G:
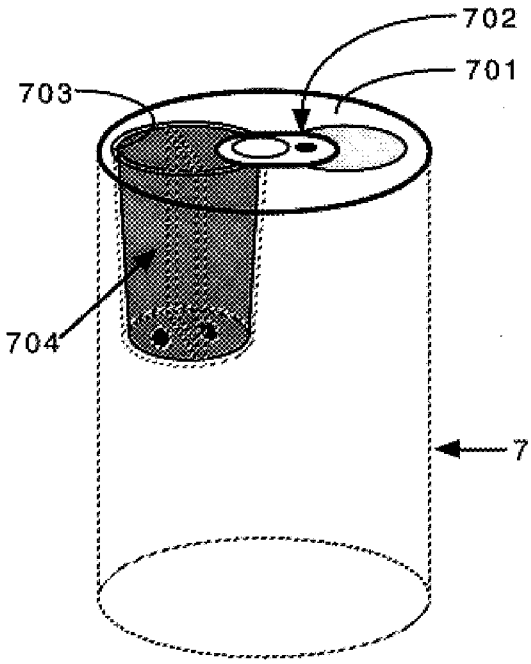

In FIGS. 7A, 7B, and 7C, a sixth embodiment of the device for use with a container can has a exterior well 703 recessed in the outer surface of the container top 701 of the container 710. The pull-tab 702 has a pull portion 702*a*, tab portion 702*b*, and center fixture 702*c* detachably mounted to a center position of the container top. In its unremoved position, the pull portion 702*a* of the pull-tab 702 overlaps partially the opening of the exterior well 703, and the tab portion 702*b* seals a tab opening 702*b*' in the container top.

As shown in FIGS. 7D, 7E, 7F, and 7G, a sub-container vessel 704 of matching shape is adapted to be carried in the exterior well 703 with its upper surface disposed evenly with the outer surface of the container top 701. As described for the earlier embodiments, the sub-container vessel has squeezable plastic outer walls and at least one inner divider wall 708 dividing its interior into compartments 705 and 706. The compartments have respective dispensing orifices 705*a* and 706*a* formed at the lower end of the vessel, which is not exposed at the surface when the vessel is seated in the exterior well. The orifices are sealed by individual, removable sealing tabs 705*c* and 706*c*.

Figure 7H:
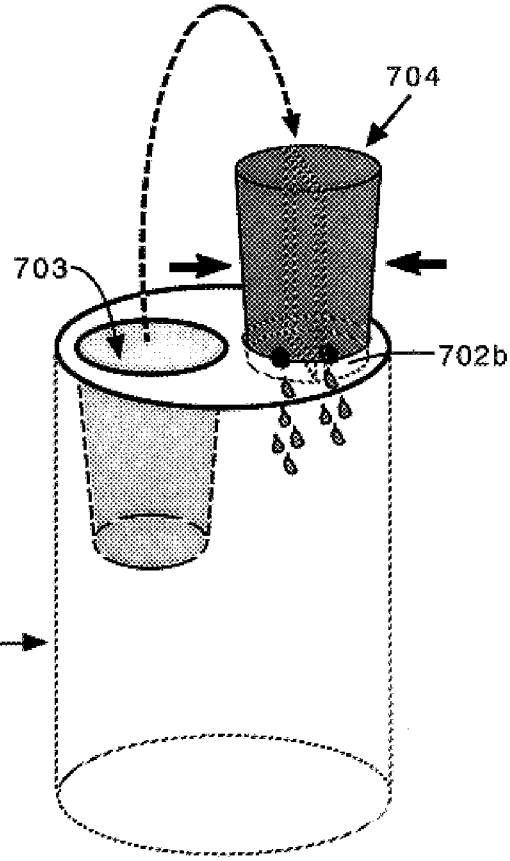

For use, as shown in FIG. 7H, when the pull-tab is removed, the vessel 704 can be removed from the exterior well 703 (by pulling on a tab 704*a*), and ingredients can be dispensed from the respective compartments by removing the sealing tabs 705*c* and 706*c* and squeezing on respective portions of the outer walls corresponding to the compartments (outlined arrows in FIG. 7H). The vessel may have thinner wall portions for the compartments, as previously described, to facilitate controllable dispensing of the respective ingredients. The exterior well can have side walls that incline outwardly to facilitate removal of the vessel, particularly if it has a depth longer than the width of the opening. For a typical beverage can having a can top of about 60 mm diameter, the exterior well can be radially spaced about 7 mm from the center position of the pull tab, and have dimensions of about 24 mm diameter at the top and a variable depth of from 10 to 40 mm. Inserting the vessel in the well is accomplished in the same manner previously described.

Figure 8A:
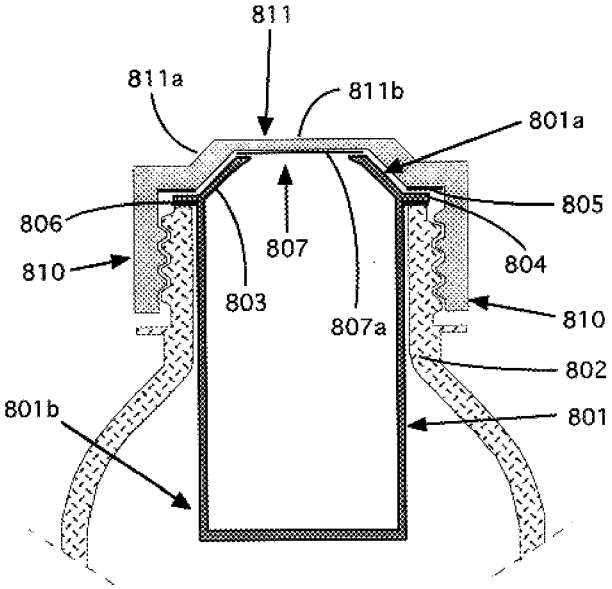
FIGS. 8A and 8B illustrate a seventh embodiment of the invention having a sub-container body mounted in the container neck which has a protruding proximate end and abutting flange for inserting into the opening in the container neck.
Figure 8B:
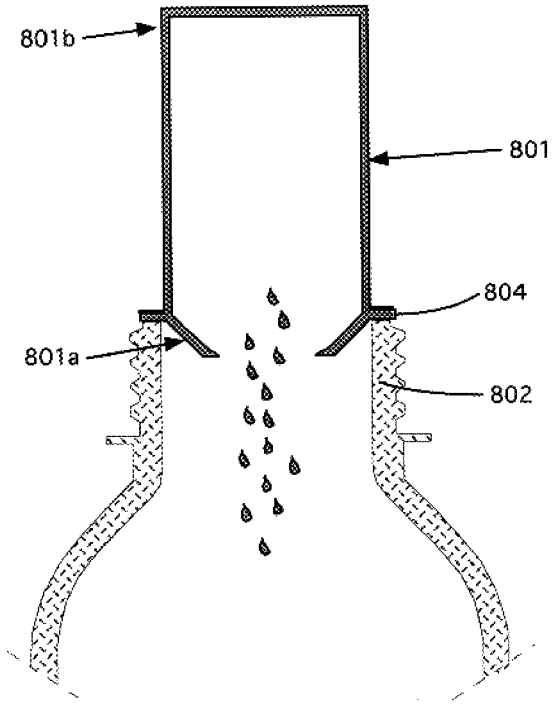

Referring to FIGS. 8A and 8B, a seventh embodiment of the device has a sub-container body 801 in cylindrical form and a proximate end 801*a* provided with inclined walls 803 leading to a central opening 807. Preferably, the container cap 810 is formed with a complementary part 811 with inclined walls 811*a* and a top wall 811*b*. The sub-container body is also formed with an annular flange 804 on its outer surface adjacent the inclined walls of the proximate end 801*a*. The sub-container body is mounted in the neck of the container covered by the cap. It can be mounted to the underside of the container cap by thermally bonding the cap and annular flange 804 with a fusible polyethylene sealing film 805. Alternatively, the sub-container body can simply be inserted by its distal end 801*b* into the container neck 802, with the annular flange 804 seated on the upper rim of the neck and held by the cap 810 threaded on the outer threading of the neck. A sealing film 806 is formed on a lower side of the annular flange 804 to act as a seal between the flange and the rim of the container neck 802.

The opening 807 in the proximate end 801*a* is sealed with a foil 807*a* adhesively sealed to the edges of the opening. When the sub-container body 801 is removed from the container neck, the sealing foil 807*a* can be removed (by its pull tab) and the protruding proximate end 801*a* can be inserted into the opening in the container neck 802 guided by the inclined walls 803 until the annular flange 804 abuts the upper rim of the neck, as shown in FIG. 8B. The action of the inclined walls guiding the protruding end into the neck opening and abutting the flange on the neck rim provides the user with a positive feel for putting the two parts together. For example, the opening in the proximate end can be a distance of about 7 mm above the annular flange, which is sufficient to allow a user to hold the sub-container body with the proximate end lodged in the container neck securely so that the combined unit can be shaken. After dispensing, the sub-container body can be discarded. The cap can be threaded on the bottle neck, and the bottle shaken further to allow complete mixing of the ingredients before use, or saved for later use.

The provision of the protruding proximate end allows ingredients contained in the sub-container body 801 to be dispensed into the container without risk of spilling or splashing outside of the container. This measure against spilling allows the use of more viscous liquids such as syrups or powdered contents in the sub-container body which can then be dislodged by shaking and/or mixed with fluid in the container by shaking.

Figure 9A:
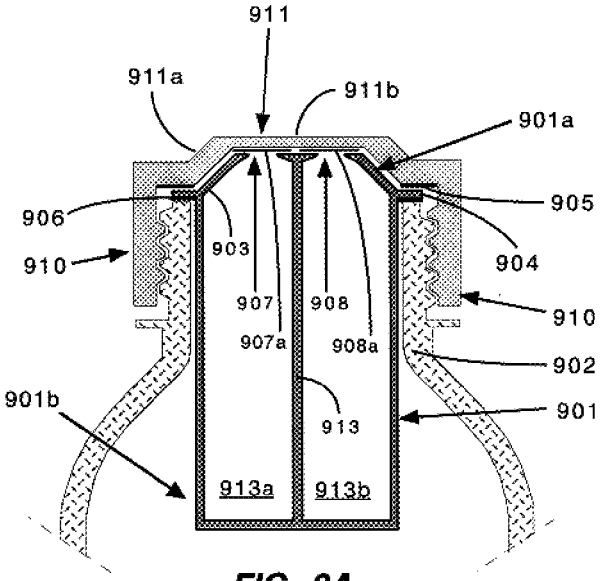
FIGS. 9A and 9B illustrate an eighth embodiment of the invention having a sub-container body mounted in the container neck which is divided into a plurality of compartments with respectively sealed orifices and which has a protruding proximate end and abutting flange for inserting into the opening in the container neck.
Figure 9B:
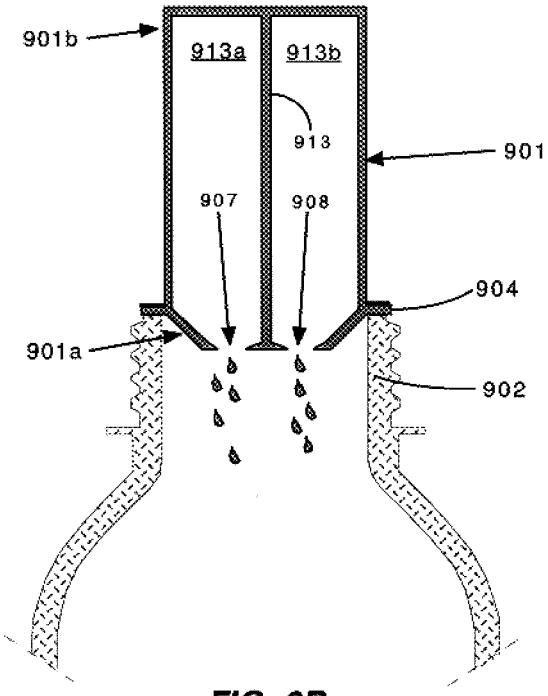

Referring to FIGS. 9A and 9B, an eighth embodiment is shown as a variation of the previously described version, in which the sub-container body 901 has an annular flange 904, inclined walls 911*b* at its proximate end 901*a*, and an inner wall 913 parallel to its cylindrical axis dividing the interior of the sub-container body into a plurality of axially oriented compartments, illustratively numbered 913*a* and 913*b*. Each compartment is formed with a dispensing orifice at the proximate end of the sub-container body, respectively 907 and 908. Each orifice is separately sealed with an adhesively foil, respectively 907*a* and 908*a*, so that they can be selectively removed, depending on the ingredients desired to be mixed with the fluid in the container. The sub-container body may be mounted to the underside of the container cap by a thermal sealing film, or held by its annular flange between the cap and the container neck.

In use, the cap 910 with complementary protruding part 911 is removed from the neck 902 of the container, and the sub-container body 901 is removed either from the underside of the cap (by pulling it from the sealing film 905) or by retrieving it from the container neck. The foil(s) are removed from the desired compartment(s), then the protruding proximate end 901*a* is inserted in the neck until the annular flange is abutted against the upper rim of the neck. The contents of the opened compartment(s) can then be shaken into and/or mixed with fluid in the container.

Figure 10A:
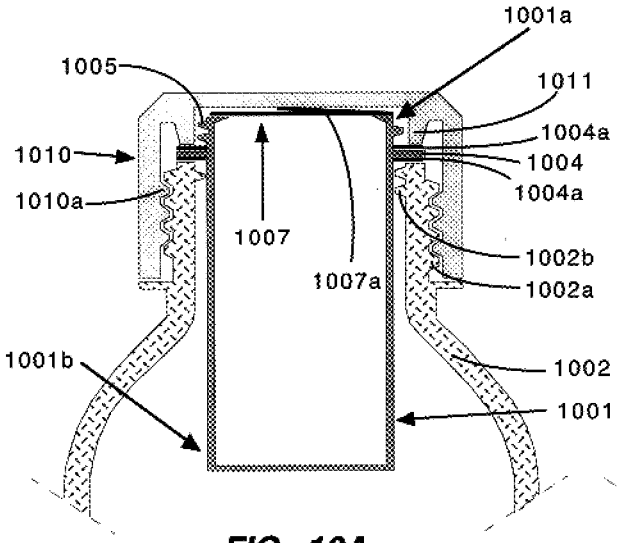
FIGS. 10A and 10B illustrate a ninth embodiment of the invention having a sub-container body with outer threading at a proximate end thereof for threading in the container neck.
Figure 10B:
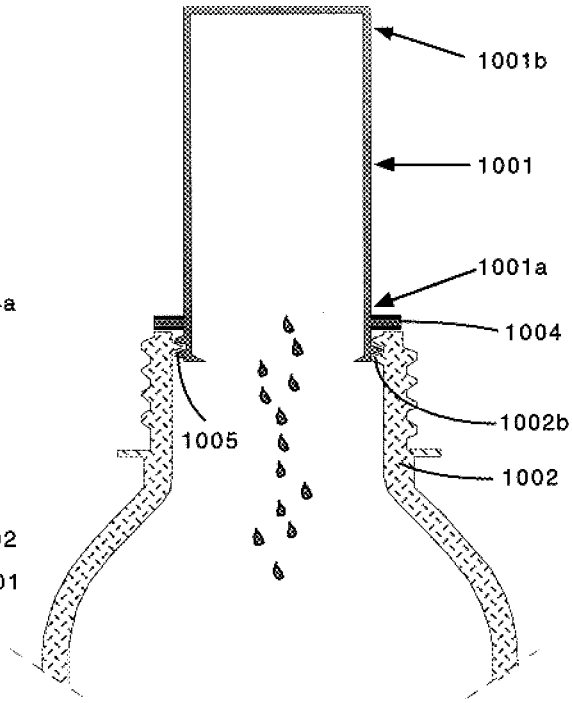

In FIGS. 10A and 10B, a ninth embodiment of the invention is shown as another variation of the single-compartment sub-container body 1001 having an annular flange 1004 and outer screw threads 1005 on an outer surface of its proximate end 1001*a*, which is provided with an opening 1007 sealed by an adhesive foil 1007*a*. The sub-container body is removably mounted by the annular flange 1004 in the container neck, held between an annular portion 1011 projecting from an underside of the container cap 1010 and an upper rim of a neck 1002 of the container. Sealing films 1004*a* are applied to the upper and lower surfaces of the annual flange. The cap 1010 is secured to the neck by inner screw threads 1010*a* mating with outer screw threads 1002*a*, respectively. The screw threads 1005 at the proximate end 1001*a* of the sub-container body are formed on its outer surface above the annular flange 1004, and engages complementary inner threads 1002*b* on the inner surface of the neck opening.

In use, when the cap 1010 is unscrewed from the container neck 1002, and the sub-container body 1001 is removed, the sealing foil 1007*a* can be removed from the opening 1007, and the proximate end 1001*a* of the sub-container body can be inserted into and threaded to the inner surface of the container neck until the annular flange 1004 abuts the upper rim of the neck, as shown in FIG. 10B. A tight seal is formed by the pressure of the abutting flange 1004 on the neck rim with the sealing film 1004*a* in between. It this manner, the sub-container body is held securely to allow the ingredients to be dispensed by shaking or mixing with fluid in the container, without risk of spilling or splashing outside of the container.

Figure 11A:
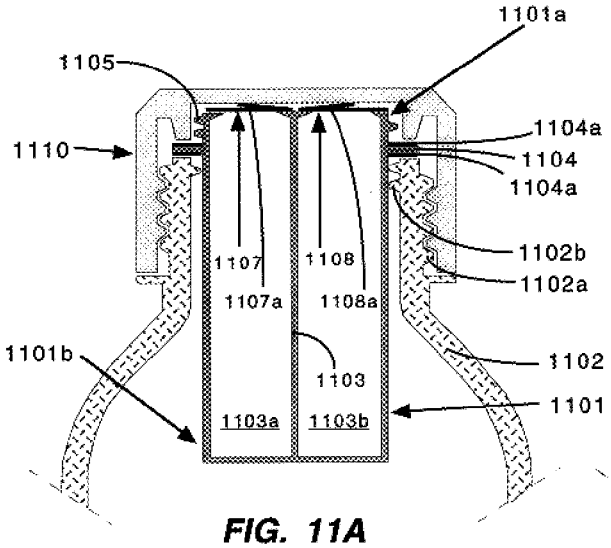
FIGS. 11A and 11B illustrate a tenth embodiment of the invention having a sub-container body divided into a plurality of compartments having respectively sealed orifices, and outer threading at a proximate end thereof for threading in the container neck.
Figure 11B:
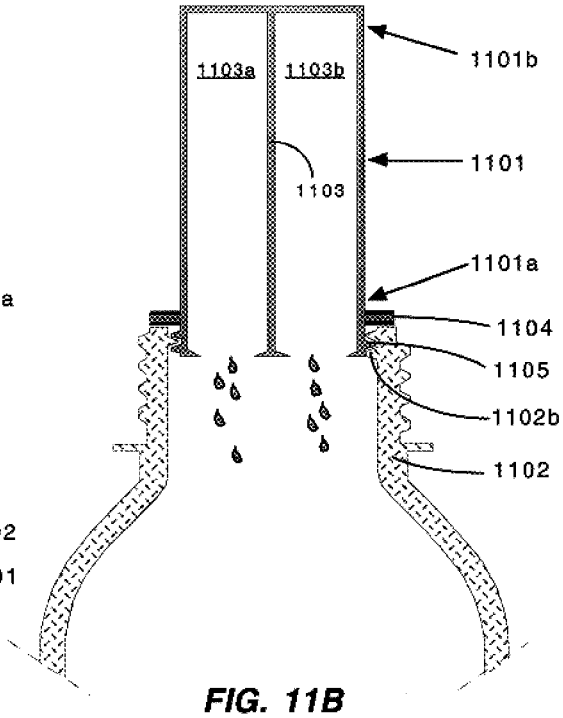

Referring to FIGS. 11A and 11B, a tenth embodiment is a variation of the previously described version, in which the sub-container body 1101 has a flange 1104, outer screw threads 1105 on an outer surface at its proximate end 1101*a*, and an inner wall 1103 parallel to its cylindrical axis dividing the interior of the sub-container body into a plurality of axially oriented compartments, illustratively numbered 1103*a* and 1103*b*. Each compartment is formed with a dispensing orifice at the proximate end of the sub-container body, respectively 1107 and 1108. Each orifice is separately sealed with an adhesively foil, respectively 1107*a* and 1108*a*, so that they can be selectively removed.

When the cap 1110 is removed from the container neck 1102, and the sub-container body 1101 is removed, the sealing foil(s) can be removed from the desired compartment(s). The sub-container body is inverted, and the proximate end 1101*a* is inserted into and threaded in the neck, with the outer threads 1105 being screwed into the inner threads 1102*b* in the neck opening, until the annular flange 1104 abuts the upper rim of the neck (with sealing film sandwiched between). A tight seal is formed by the pressure of the abutting flange 1004 on the neck rim with the sealing film 1004*a* in between. The entire unit can then be vigorously shaken to fully dispense and mix viscous or powdered contents with the fluid contents of the container. After complete dispensing and mixing, the sub-container body is removed, and the mixed contents of the container are ready to be consumed.

In FIGS. 12A–12D, an eleventh embodiment of the invention has a sub-container body 1201 formed integrally with the container cap 1200. The sub-container body has an annular flange 1204 formed as its proximate end which is connected to the depending annular flange 1210 of the cap 1201. The cap has inner screw threads formed on an inner surface of the depending flange 1210 which engage complementary screw threads formed on an outer surface of the container neck 1202. The sub-container body has a hollow interior 1213 and an opening at its proximate end which is covered by an outer flap 1216. The flap can be hinged to one side of the cap and have a rim 1216*a* which snap engages with an annular bead around the cap. The sub-container opening may be sealed with an adhesive foil 1207. The sub-container body is removable from the container neck with the container cap. Ingredients held in the hollow interior are dispensed by opening the flap and unsealing the seal 1207, and pouring them into the container neck. The sub-container may be re-sealed by the hinged flap 1216.

Figure 12A:
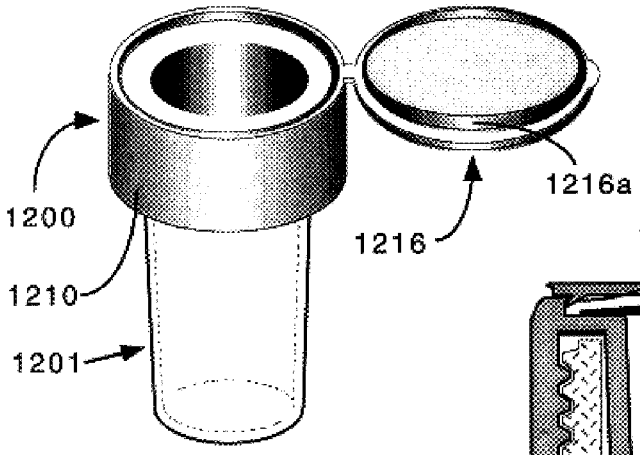
FIGS. 12A–12D illustrate an eleventh embodiment of the invention having a sub-container body which is formed integrally with the container cap and is provided with a hollow interior and an outer flap for holding separate ingredients or an ingredient-holding container therein.
Figure 12B:
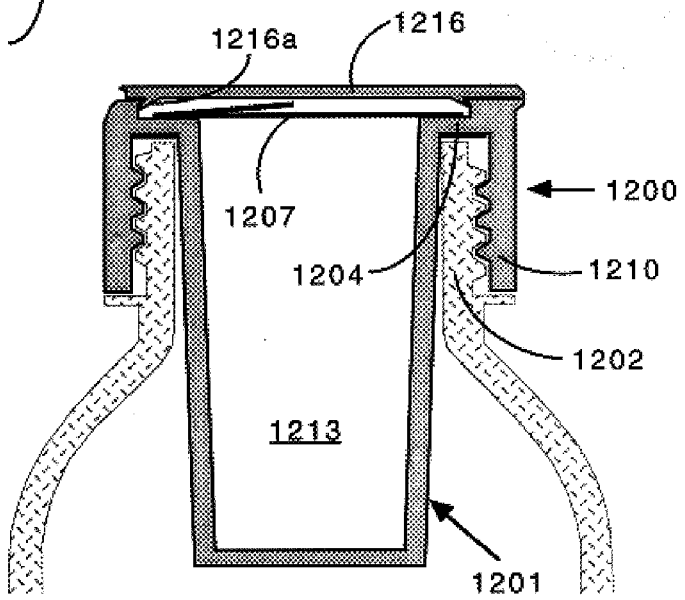
Figure 12C:
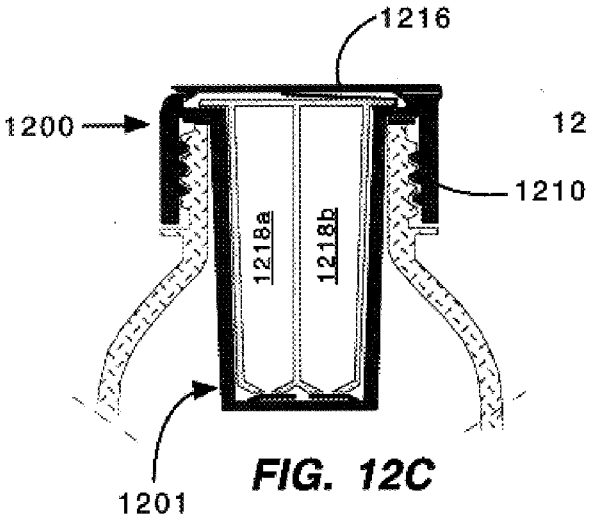
Figure 12D:
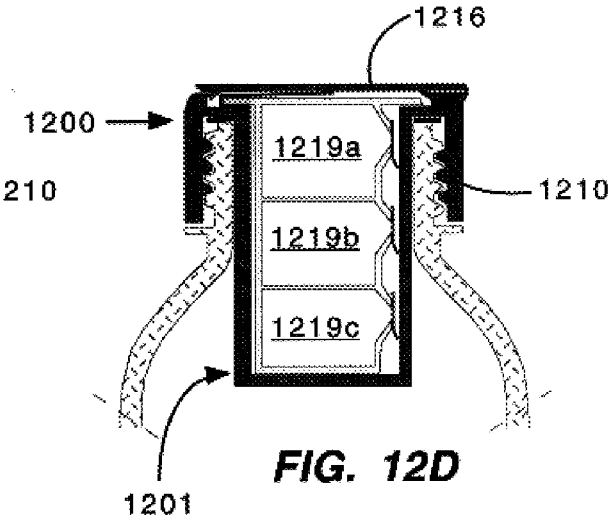

Ingredients may be stored directly in the hollow interior 1213 of the sub-container body, or other ingredient package units may be stored therein, such as the multi-compartment units 1218 and 1219 shown in FIGS. 12C and 12D, respectively. The volume of the sub-container can vary with diameter and depth in the container neck opening. The sub-container may also be used to store non-ingredients such as pills, toys, or prizes. Toys placed in the sub-container could be used to entice children to drink the container's nutritional formulations, medications, vegetable juices, etc. New marketing strategies can be fashioned by placing coupons or drawing tickets in the interior.

With this version, the cap and sub-container body are an integral unit. The ingredients or package units held in the sub-container body would not come into contact with the fluids in the container at all. This would increase the shelf life and intactness of the sealed units. Dry ingredients can be dispensed into the container readily since they are kept completely dry.

Figure 13A:
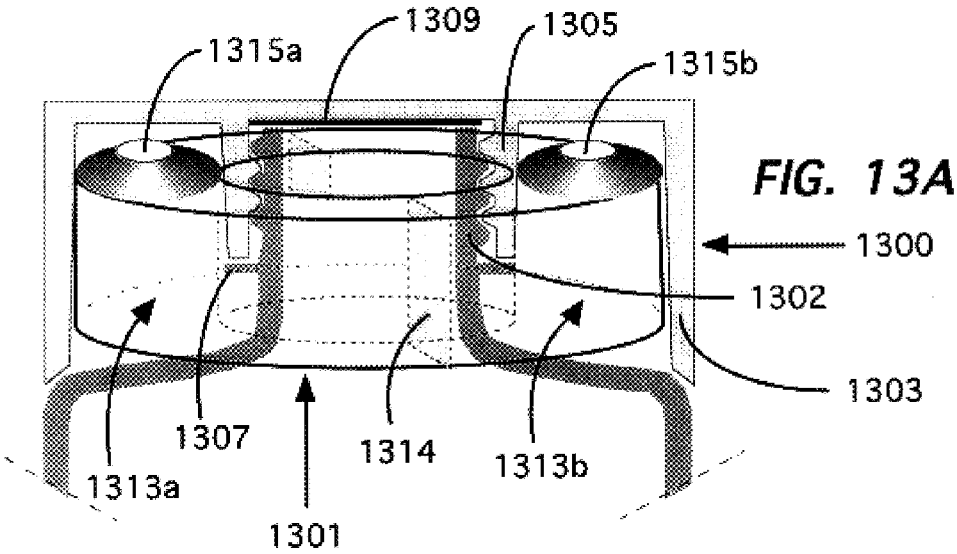
FIGS. 13A–13C illustrate a twelfth embodiment of the invention having a sub-container body in annular ring form mounted between inner and outer depending flanges of the container cap.
Figure 13B:
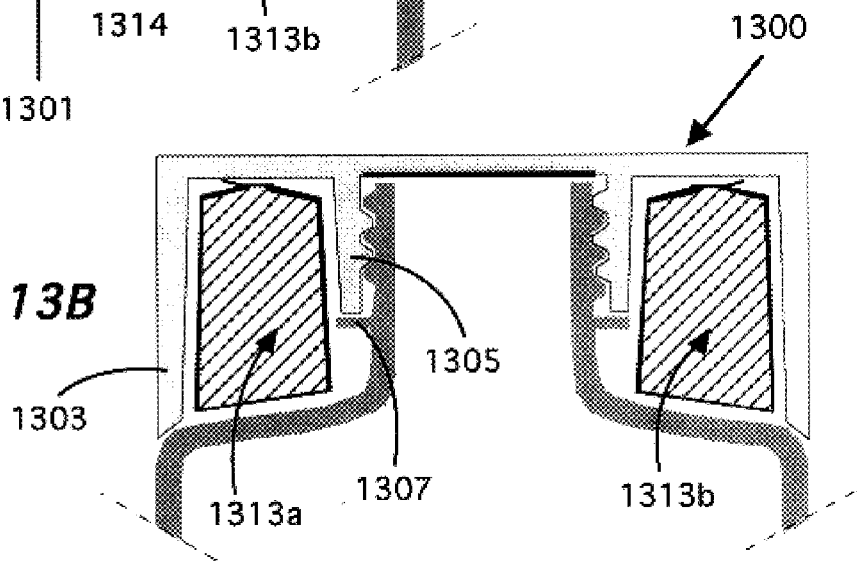
Figure 13C:
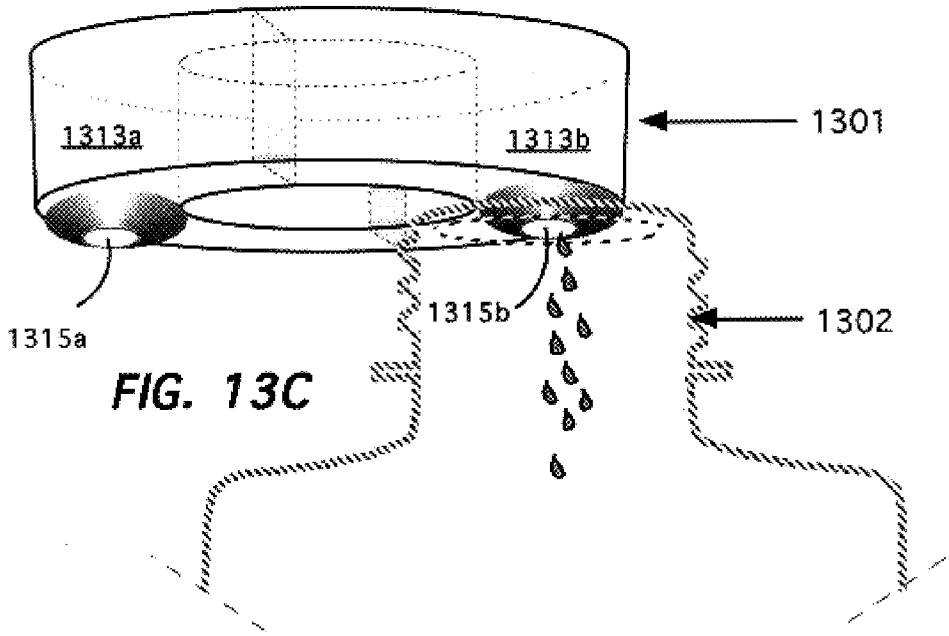

In FIGS. 13A–13C, a twelfth embodiment is shown having a sub-container body 1301 in annular ring form which is mounted between inner and outer depending annular flanges 1305 and 1303, respectively of the container cap 1300. The container cap 1300 has an inner bore provided with screw threads on an inner surface thereof facing inwardly for engagement with screw threads formed on an outer surface of the container neck 1302. The sub-container body 1301 has at least one compartment formed therein for holding separate ingredients. Two compartments 1313*a*, 1313*b* are formed by divider walls 1314, and have respective dispensing orifices 1315*a*, 1315*b* for dispensing the respective ingredients selectively into the container neck (see FIG. 13C). The number of compartments can be increased with additional divider walls, and are distributed radially around the annular ring form of the sub-container body. A seal 1309 may be adhered over the opening of the container neck to keep the fluids in the container from leaking out. A step flange 1307 may be provided on the outer surface of the container neck for positive engagement with the inner annular flange 1305 of the container cap.

In this version, the sub-container body is carried entirely outside of the bottle without contacting the fluids in the bottle. This would increase the shelf life of the container and ingredients, and ensure easy dispensing for dry ingredients. This is especially suitable for fluids other than water. For bottles having a cylindrical body and narrow bottle neck, the annular ring form of the container cap holding the sub-container body can be made flush with the outer diameter of the container body, so that the bottle resembles a can in shape and can be stocked in and dispensed from can vending machines.

With these improved devices, multiple ingredients can be safely stored separately from the carrier liquid and conveniently used and controllably metered to the user's tastes. The device structures can be manufactured using standard plastic molding or extrusion production, lamination, filling, and sealing techniques at relatively low cost. The multiple compartments provided by the devices allow a wide range of ingredients to be stored separately and added at the time of use, thereby increasing the types of products that can be produced and marketed, and accommodating a greater range of consumer choices and tastes.

For beverages, sauces, and condiments having high sugar content which might otherwise ferment, the ingredients can be kept separate and mixed in the liquid media at the time of use, thereby allowing the product to be packaged without the need for preservatives. The taste of such products can be improved by keeping flavorings separate until ready to use and by lower levels or elimination of preservatives. Such products can also be exported to countries which have strict controls on the use of preservatives.

A wide range of new liquid food products can be introduced to the marketplace where previously the ingredients might be unstable or become deteriorated when stored with oxygenated water, soda, and other liquid media. Health products using oxygenated water can thus be handled in mass market packaging, shipping, and vending environments.

The multiple compartments of the new device would also allow a variety of flavors to be delivered with a packaged beverage product and allow the user to select the one or ones they prefer. This would allow the manufacturer to produce and ship only one product to the market in place of multiple products that would incur multiplied production, shipping, handling, storage, and stocking costs.

It is to be understood that many modifications and variations may be devised given the above description of the principles of the invention. It is intended that all such modifications and variations be considered as within the spirit and scope of this invention, as defined in the following claims.

I claim:

1. A device for maintaining ingredients separately in a container of the type having a container neck with a central opening and screw threads on an outer surface thereof, comprising:

a removable container cap having screw threads for attaching it to the screw threads on the container neck;

a sub-container body in cylindrical form which is integrally formed with the container cap so as to be removably mounted in the opening in the container neck, said sub-container body having a hollow interior therein which is covered by an outer flap so that the hollow interior of the sub-container body is accessible by opening the outer flap externally of the container, said sub-container body having a proximate end provided with an opening into the interior thereof which is covered by the outer flap and connected to an external flange of the container cap, said external flange having screw threads formed on its inner surface facing inwardly for engagement with the screw threads on the outer surface of the container neck, and said sub-container body containing in the interior thereof ingredients to be maintained separately in the container which can be removed from the sub-container body by opening said outer flap externally of the container.

2. A device for maintaining ingredients according to claim 1, wherein said outer flap is hinged to one side of the container cap and covers the opening at the proximate end of the sub-container body leading in to the hollow interior.

3. A device for maintaining ingredients according to claim 1, wherein said hollow interior of the sub-container body holds a multi-compartment package unit therein having a plurality of separately openable compartments each holding a respective one of a plurality of separate ingredients.

4. A device for maintaining ingredients according to claim 1, wherein said hollow interior of the sub-container body holds non-ingredient prize objects therein.

* * * * *

UNITED STATES PATENT AND TRADEMARK OFFICE

CERTIFICATE OF CORRECTION

PATENT NO. : 6,263,923 B1
DATED : July 24, 2001
INVENTOR(S) : James A. Castillo

It is certified that error appears in the above-identified patent and that said Letters Patent is hereby corrected as shown below:

Title page,
The title page showing the illustrative figures, should be deleted to appear as per the attached title page.

Signed and Sealed this

Sixth Day of August, 2002

*Attest:*

*Attesting Officer*

JAMES E. ROGAN
*Director of the United States Patent and Trademark Office*

(12) United States Patent
Castillo

(10) Patent No.: US 6,263,923 B1
(45) Date of Patent: Jul. 24, 2001

(54) DEVICE FOR MAINTAINING SEPARATE INGREDIENTS IN LIQUID FOOD PRODUCTS

(76) Inventor: James A. Castillo, 1848 Kahakai Dr., #1506, Honolulu, HI (US) 96814

( * ) Notice: Subject to any disclaimer, the term of this patent is extended or adjusted under 35 U.S.C. 154(b) by 0 days.

(21) Appl. No.: 09/493,361

(22) Filed: Jan. 28, 2000

Related U.S. Application Data

(63) Continuation-in-part of application No. 09/321,676, filed on May 28, 1999.

(51) Int. Cl.[7] ..... B65B 1/04; B65B 3/04; B67C 3/02

(52) U.S. Cl. ..... 141/100; 141/104; 141/110; 141/112; 220/501; 220/502; 215/227; 215/DIG. 8; 206/219; 206/222

(58) Field of Search ..... 141/100, 102, 141/104, 110, 112; 222/83, 129, 142.5, 94–100; 220/23.88, 503; 215/6, 227, DIG. 8; 206/219–222

(56) References Cited

U.S. PATENT DOCUMENTS

| | | | |
|---|---|---|---|
| 3,179,275 | 4/1965 | Roskam . | |
| 3,225,915 | 12/1965 | Wise . | |
| 3,779,372 | 12/1973 | de Lloret . | |
| 4,024,952 | 5/1977 | Leitz . | |
| 4,221,291 | 9/1980 | Hunt . | |
| 4,264,007 | 4/1981 | Hunt . | |
| 4,618,444 | 10/1986 | Hudson . | |
| 5,064,073 | 11/1991 | Folland . | |
| 5,114,011 | 5/1992 | Robbins, III . | |
| 5,431,276 | 7/1995 | Lialin . | |
| 5,529,179 | 6/1996 | Hanson . | |
| 5,885,635 | 3/1999 | Spring et al. . | |
| 6,003,728 * | 12/1999 | Elliott | 222/81 |
| 6,047,818 * | 4/2000 | Warby et al. | 206/221 |
| 6,059,443 * | 5/2000 | Casey | 366/130 |
| 6,152,296 * | 11/2000 | Shih | 206/222 |

* cited by examiner

*Primary Examiner*—Timothy L. Maust
(74) *Attorney, Agent, or Firm*—Leighton K. Chong

(57) ABSTRACT

A device for maintaining ingredients separately within a container, of the type having a removable container cap applied on a neck with a central opening, has a sub-container body mounted in the container neck which is formed with a proximate end having screw threads which can be engaged with internal screw threads in the container neck for holding them securely together to allow the ingredients to be shaken out of the sub-container body and mixed with fluid in the container. The sub-container body can have inner divider walls forming multiple compartments with respective orifices for dispensing ingredients selectively from the compartments. The sub-container body may be sealed to the underside of the cap with a sealing film, or seated on the neck rim and held by the cap. In one version, the proximate end of the sub-container body has a protruding shape with inclined walls for guiding it into the neck opening. In other versions, the sub-container body is formed integrally with the container cap, or is formed as an annular ring shape carried between inner and outer flanges of the cap. These improved devices allow viscous or powdered ingredients to be mixed by shaking with fluid in the container without risk of spilling or splashing outside the container.

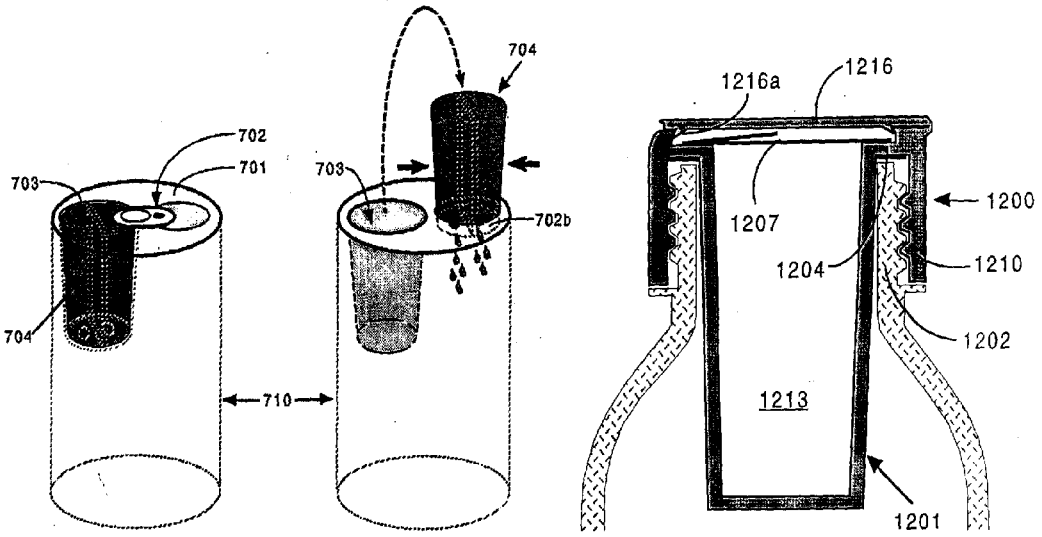

4 Claims, 22 Drawing Sheets